US010912348B2

(12) United States Patent
Owings et al.

(10) Patent No.: US 10,912,348 B2
(45) Date of Patent: Feb. 9, 2021

(54) EASY ACCESS ARTICLES OF FOOTWEAR

(71) Applicant: NIKE, Inc., Beaverton, OR (US)

(72) Inventors: Andrew A. Owings, Beaverton, OR (US); Kevin J. Rucier, Beaverton, OR (US); Phillip Anthony Meneau, Portland, OR (US); Wilson W. Smith, III, Tualatin, OR (US)

(73) Assignee: NIKE, Inc., Beaverton, OR (US)

( * ) Notice: Subject to any disclaimer, the term of this patent is extended or adjusted under 35 U.S.C. 154(b) by 456 days.

(21) Appl. No.: 15/787,745

(22) Filed: Oct. 19, 2017

(65) Prior Publication Data

US 2018/0110289 A1 Apr. 26, 2018

Related U.S. Application Data

(60) Provisional application No. 62/412,956, filed on Oct. 26, 2016.

(51) Int. Cl.

| | |
|---|---|
| ***A43B 13/14*** | (2006.01) |
| ***A43B 11/00*** | (2006.01) |
| ***A43C 11/16*** | (2006.01) |
| ***A43B 13/18*** | (2006.01) |
| ***A43C 11/14*** | (2006.01) |

(Continued)

(52) U.S. Cl.

CPC ..... *A43B 13/141* (2013.01); *A43B 1/14* (2013.01); *A43B 3/24* (2013.01); *A43B 11/00* (2013.01); *A43B 13/182* (2013.01); *A43B 13/186* (2013.01); *A43B 23/0245* (2013.01); *A43C 11/008* (2013.01); *A43C 11/1493* (2013.01); *A43C 11/165* (2013.01)

(58) Field of Classification Search

CPC ..... A43B 13/141; A43B 3/24; A43B 13/16; A43B 13/182; A43B 13/186; A43B 11/02; A43B 11/00; A43B 23/0245; A43B 1/14; A43C 11/008; A43C 11/165; A43C 11/00; A43C 11/16; A43C 11/1493; A61F 5/0195

USPC .... 36/105, 118.2, 97, 72 R, 71.5, 58.5, 50.5, 36/138, 50.1, 102, 58.6

See application file for complete search history.

(56) References Cited

U.S. PATENT DOCUMENTS

| | | | |
|---|---|---|---|
| 171,301 | A | 12/1875 | McKee |
| 474,574 | A | 5/1892 | Bruzon |

(Continued)

FOREIGN PATENT DOCUMENTS

| | | | |
|---|---|---|---|
| CN | 2052208 | U | 2/1990 |
| CN | 102595952 | B | 4/2015 |

(Continued)

*Primary Examiner* — Nathan E Durham
*Assistant Examiner* — Abby M Spatz
(74) *Attorney, Agent, or Firm* — Banner & Witcoff, Ltd.

(57) ABSTRACT

Foot support systems (and articles of footwear including them) include: (a) a medial side member having one or more medial side supports (e.g., ribs); (b) a lateral side member having one or more lateral side supports (e.g., ribs); and (c) structure (such as a hinge system) configured to move the foot support system (e.g., the medial side support(s) with respect to the lateral side support(s)) between: (a) a foot-insertion configuration and (b) a foot-containing configuration. In moving from the foot-insertion configuration to the foot-containing configuration, the foot support system can be changed between an open condition and a closed condition.

20 Claims, 14 Drawing Sheets

(51) Int. Cl.

| | |
|---|---|
| ***A43B 3/24*** | (2006.01) |
| ***A43B 23/02*** | (2006.01) |
| ***A43C 11/00*** | (2006.01) |
| ***A43B 1/14*** | (2006.01) |

(56) References Cited

U.S. PATENT DOCUMENTS

| | | | | |
|---|---|---|---|---|
| 537,627 | A | 4/1895 | Bixby et al. | |
| 955,337 | A | 4/1910 | Lawlor | |
| 1,686,175 | A | 10/1928 | Read | |
| 2,252,315 | A | 8/1941 | Doree | |
| 2,357,980 | A | 9/1944 | Spiro | |
| 2,450,250 | A | 9/1948 | Napton | |
| 2,452,649 | A | 11/1948 | Graves | |
| 2,829,448 | A * | 4/1958 | Minera | A43C 11/00 36/58.5 |
| 3,146,535 | A | 9/1964 | Owings | |
| 3,192,651 | A | 7/1965 | Smith | |
| 3,530,596 | A * | 9/1970 | Kaufmann | A43B 5/04 36/99 |
| 3,681,860 | A | 8/1972 | Bidegain | |
| 4,095,356 | A | 6/1978 | Robran et al. | |
| 4,136,468 | A | 1/1979 | Munschy | |
| 4,665,634 | A | 5/1987 | Diaz | |
| 5,054,216 | A | 10/1991 | Lin | |
| 5,184,410 | A | 2/1993 | Hamilton | |
| 5,282,327 | A | 2/1994 | Ogle | |
| 5,481,814 | A | 1/1996 | Spencer | |
| 5,557,866 | A | 9/1996 | Prengler | |
| 5,813,144 | A | 9/1998 | Prengler | |
| 5,983,531 | A * | 11/1999 | Chaigne | A43C 11/1406 36/50.5 |
| 6,189,239 | B1 | 2/2001 | Gasparovic et al. | |
| 6,594,921 | B2 | 7/2003 | Laio et al. | |
| 6,643,954 | B2 | 11/2003 | Voswinkel | |
| 7,055,268 | B2 | 6/2006 | Ha | |
| 7,178,270 | B2 | 2/2007 | Hurd et al. | |
| 7,287,294 | B2 | 10/2007 | Miller et al. | |
| 7,448,148 | B2 | 11/2008 | Martinez et al. | |
| 7,472,495 | B2 | 1/2009 | Milbourn | |
| 7,607,242 | B2 | 10/2009 | Karandonis et al. | |
| 7,685,747 | B1 | 3/2010 | Gasparovic et al. | |
| 7,793,438 | B1 | 9/2010 | Busse et al. | |
| 8,161,669 | B2 | 4/2012 | Keating | |
| 8,215,030 | B2 | 7/2012 | Bowen et al. | |
| 8,225,534 | B2 | 7/2012 | Mueller et al. | |
| 8,245,421 | B2 | 8/2012 | Baudouin et al. | |
| 8,365,443 | B2 | 2/2013 | Huynh | |
| 8,499,474 | B2 | 8/2013 | Kaufman | |
| 8,549,774 | B2 | 10/2013 | Meschter et al. | |
| 8,635,791 | B2 | 1/2014 | Baudouin et al. | |
| 9,089,184 | B1 | 7/2015 | Kiser et al. | |
| 9,265,305 | B2 | 2/2016 | Hatfield et al. | |
| 9,414,640 | B2 | 8/2016 | Nichols | |
| 2002/0035795 | A1 * | 3/2002 | Smith | A43C 11/00 36/50.1 |
| 2002/0174568 | A1 | 11/2002 | Neiley | |
| 2004/0111921 | A1 | 6/2004 | Lenormand | |
| 2007/0186441 | A1 | 8/2007 | Chen | |
| 2008/0184592 | A1 * | 8/2008 | Brie | A43B 3/16 36/7.1 R |
| 2010/0319216 | A1 | 12/2010 | Grenzke et al. | |
| 2012/0079746 | A1 | 4/2012 | Ferreira et al. | |
| 2014/0298687 | A1 | 10/2014 | Flinterman et al. | |
| 2014/0360049 | A1 | 12/2014 | Panian et al. | |
| 2015/0216252 | A1 | 8/2015 | Wiens | |

FOREIGN PATENT DOCUMENTS

| | | | |
|---|---|---|---|
| DE | 3310988 | A1 | 9/1984 |
| EP | 1952715 | A1 | 8/2008 |
| FR | 2994800 | B1 | 3/2015 |
| GB | 1154145 | A | 6/1969 |
| WO | 2003039283 | A1 | 5/2003 |
| WO | 2006084185 | A1 | 8/2006 |
| WO | 2014033396 | A1 | 3/2014 |
| WO | 20140140443 | A1 | 9/2014 |

* cited by examiner

EASY ACCESS ARTICLES OF FOOTWEAR

RELATED APPLICATION DATA

This application is a non-provisional of and claims priority benefits based on U.S. Provisional Patent Application No. 62/412,956 filed Oct. 26, 2016 entitled "Easy Access Articles of Footwear." U.S. Provisional Patent Application No. 62/412,956 is entirely incorporated herein by reference.

FIELD OF THE INVENTION

The present invention relates to the field of footwear. Some aspects of the present invention pertain to foot support systems and articles of footwear that include such foot support systems that are easy to put on, easy to secure, and/or allow easy entry from a rear heel area of the shoe.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure supports and protects the foot and may provide traction and help control potentially harmful foot motion, such as over pronation. General features and configurations of the upper and sole structure are discussed in greater detail below.

The upper forms a void on the interior of the footwear for receiving the foot. The void has the general shape of the foot, and access to the void is provided at an ankle opening. Accordingly, the upper may extend over the instep and toe areas of the foot, along the medial and lateral sides of the foot, and around the heel area of the foot. A lacing system often is incorporated into the upper to allow selective changes to the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

Terminology/General Information

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

The terms "forward" or "forward direction" as used herein, unless otherwise noted or clear from the context, mean at, toward, or in a direction toward a forward-most toe area of the footwear structure or component. The terms "rear," "rearward," or "rearward direction" as used herein, unless otherwise noted or clear from the context, mean at, toward, or in a direction toward a rear-most heel area of the footwear structure or component. The terms "lateral" or "lateral side" as used herein, unless otherwise noted or clear from the context, mean the outside or "little toe" side of the footwear structure or component. The terms "medial" or "medial side" as used herein, unless otherwise noted or clear from the context, mean the inside or "big toe" side of the footwear structure or component.

In the following description of various example structures in accordance with the invention, reference is made to the accompanying drawings, which form a part hereof, and in which are shown by way of illustration various example foot support structures, components thereof, and articles of footwear in accordance with aspects and examples of the invention. It is to be understood that other specific arrangements of parts and structures may be utilized, and structural and functional modifications may be made without departing from the scope of the present invention. Also, while the terms "top," "bottom," "front," "back," "rear," "side," "underside," "overhead," "over," "under" and the like may be used in this specification to describe various example features and elements of the invention, these terms are used herein as a matter of convenience, e.g., based on the example orientations shown in the figures and/or the orientations in typical use (e.g., orientation when incorporated into an article of footwear supported on the bottom of its sole structure on a horizontal support surface).

SUMMARY

This Summary is provided to introduce some concepts relating to this invention in a simplified form that are further described below in the Detailed Description. This Summary is not intended to identify key features or essential features of the invention.

While potentially useful for any desired types or styles of footwear, aspects of this invention may be of particular interest for casual wear shoes, athletic shoes, etc. As noted above, some aspects of the present invention pertain to foot support systems and articles of footwear that include such foot support systems that are easy to put on, easy to secure, and/or allow easy entry from a rear heel area of the footwear structure.

Some aspects and examples of this invention relate to foot support systems (and articles of footwear including them) that include: (a) a medial side member including one or more medial side supports; (b) a lateral side member including one or more lateral side supports; and (c) structure (such as a hinge system) configured to move the foot support system (e.g., move the medial side support(s) with respect to the lateral side support(s)) between: (a) a foot-insertion configuration and (b) a foot-containing configuration. In moving from the foot-insertion configuration to the foot-containing configuration, at least some medial side structures (e.g., interior surface(s) of the medial side support(s) and/or interior surface(s) of a medial base member) will move with respect to at least some of the lateral side structures (e.g., interior surface(s) of the lateral side support(s) and/or interior surface(s) of a lateral base member) in a direction toward one another (e.g., the facing surfaces of these medial and lateral side components may move toward one another), for example, to close around a wearer's foot (e.g., at the midfoot area). In moving from the foot-containing configuration to the foot-insertion configuration, at least some medial side structures (e.g., interior surface(s) of the medial side support(s) and/or interior surface(s) of a medial base member) will move with respect to at least some of the lateral side structures (e.g., interior surface(s) of the lateral side support(s) and/or interior surface(s) of a lateral base member) in a direction away from one another (e.g., the facing surfaces of these medial and lateral side components may move away from one another), for example, to open up and/or move away from a wearer's foot.

Some more specific aspects and examples of this invention relate to foot support systems, e.g., incorporated into articles of footwear, that include: (a) a medial side member including a medial side foot support base and at least a first medial side support extending upward from the medial side foot support base; (b) a lateral side member including a lateral side foot support base and at least a first lateral side support extending upward from the lateral side foot support base; and (c) a hinge system connecting the medial side foot support base and the lateral side foot support base in a relative rotational manner. In at least some example structures according to this aspect of the invention, this hinge system is configured to move the foot support system between: (a) a foot-insertion configuration and (b) a foot-containing configuration, in which:

(i) in moving from the foot-insertion configuration to the foot-containing configuration, interior surface(s) of the medial side member and interior surface(s) of the lateral side member (or facing surfaces of these members) rotate about the hinge system with respect to one another in a direction toward one another, e.g., to close around a wearer's foot, and (ii) in moving from the foot-containing configuration to the foot-insertion configuration, interior surface(s) of the medial side member and interior surface(s) of the lateral side member (or facing surfaces of these members) rotate about the hinge system with respect to one another in a direction away from one another, e.g., to open up and/or move away from a wearer's foot.

Additionally or alternatively, a locking system may be provided to releasably lock the hinge system, e.g., to hold the foot support system in at least one of the foot-containing configuration and/or the foot-insertion configuration. As another additional, alternative, or optional feature, a switch system may be provided, e.g., to move the foot support system from the foot-containing configuration to the foot-insertion configuration and/or from the foot-insertion configuration to the foot-containing configuration. Optionally, such locking systems and/or switching systems can operate in a "hands-free" manner.

Other aspects and examples of this invention relate to foot support systems, e.g., incorporated into articles of footwear, that include: (a) a medial side member including a plurality of medial side support ribs configured to extend along a medial side portion of the foot support system; and (b) a lateral side member including a plurality of lateral side support ribs configured to extend along a lateral side portion of the foot support system. The medial side member and the lateral side member may be engaged together (or with one or more other structures) such that the plurality of medial side support ribs and the plurality of lateral side support ribs are movable with respect to one another between: (a) a foot-insertion configuration and (b) a foot-containing configuration, in which:

(i) in moving from the foot-insertion configuration to the foot-containing configuration, interior surfaces of the plurality of medial side support ribs and interior surfaces of the plurality of lateral side support ribs (e.g., the facing surfaces of these support ribs) rotate in a direction toward one another, e.g., to close around a wearer's foot, and (ii) in moving from the foot-containing configuration to the foot-insertion configuration, interior surfaces of the plurality of medial side support ribs and interior surfaces of the plurality of lateral side support ribs (e.g., the facing surfaces of these support ribs) rotate in a direction away from one another, e.g., to open up and/or move away from a wearer's foot.

In such structures, a locking system may be provided, e.g., to releasably lock the plurality of medial side support ribs and the plurality of lateral side support ribs in at least one of the foot-containing configuration and/or the foot-insertion configuration. Additionally or alternatively, a switch system may be provided, e.g., to move these pluralities of support ribs from the foot-containing configuration to the foot-insertion configuration and/or from the foot-insertion configuration to the foot-containing configuration. In some examples, such locking systems and/or switching systems can operate in a "hands free" manner.

Additional aspects of this invention relate to articles of footwear that incorporate foot support structures, e.g., of the types described above. The foot support structures may be engaged with or integrally formed as part of either or both of an upper or a sole structure for the article of footwear.

As more specific examples, articles of footwear according to some aspects of this invention include: an upper and a sole structure engaged with the upper, wherein the sole structure includes a forefoot support portion, a heel support portion, a midfoot support portion located between the forefoot support portion and the heel support portion, a lateral side, and a medial side. The heel support portion may be rotatable with respect to the forefoot support portion on a first axis located in the midfoot support portion, e.g., an axis that extends from the lateral side to the medial side of the sole structure. These example articles of footwear further may include: (a) a medial side foot support base portion supported by or constituting a portion of the sole structure, (b) a first medial side support extending upward from the medial side foot support base portion; (c) a lateral side foot support base portion supported by or constituting a portion of the sole structure, and (d) a first lateral side support extending upward from the lateral side foot support base portion. The first medial side support and/or the first lateral side support may be formed as part of and/or engaged with the footwear upper and/or the footwear sole structure. The medial side foot support base portion and the lateral side foot support base portion may be movable with respect to one another, e.g., about a second axis that extends in a direction from the forefoot support portion to the heel support portion of the sole structure (e.g., an axis extending in a longitudinal or front-to-back direction of the article of footwear), e.g., as described above.

Other article of footwear aspects and examples of this invention may include: an upper and a sole structure engaged with the upper, wherein the sole structure includes a forefoot support portion, a heel support portion, a midfoot support portion located between the forefoot support portion and the heel support portion, a lateral side, and a medial side. The heel support portion may be rotatable with respect to the forefoot support portion on a first axis located in the midfoot support portion, e.g., an axis that extends from the lateral side to the medial side of the sole structure. These example articles of footwear further may include a foot support system engaged with and/or constituting a part of at least one of the upper or the sole structure, and this foot support system may include: (a) a medial side member including a plurality of medial side support ribs configured to extend along a medial side portion of the article of footwear, and (b) a lateral side member including a plurality of lateral side support ribs configured to extend along a lateral side portion of the article of footwear. The plurality of medial side support ribs and the plurality of lateral side support ribs are movable with respect to one another, e.g., about a second axis that extends in a direction from the forefoot support portion to the heel support portion of the sole structure, e.g., as described above.

The "foot-insertion configuration" described above may be the same as or similar to a "foot-removal configuration," i.e., a configuration of the foot support system when a user removes his/her foot from the shoe. Both of these terms are used in the discussion below, and these terms may refer generally to the same configuration and/or arrangement of the component parts.

Additional aspects of this invention relate to methods of making foot support systems and/or articles of footwear, e.g., of the various types and structures described above (and described in more detail below) and/or that perform the various functions described above (and described in more detail below).

Given this general description and background information, more specific examples of sole structures, sole structure components, upper structures, upper structure components, and articles of footwear in accordance with aspects of this invention will be described with reference to FIGS. 1A-7D.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

Figure 1A:
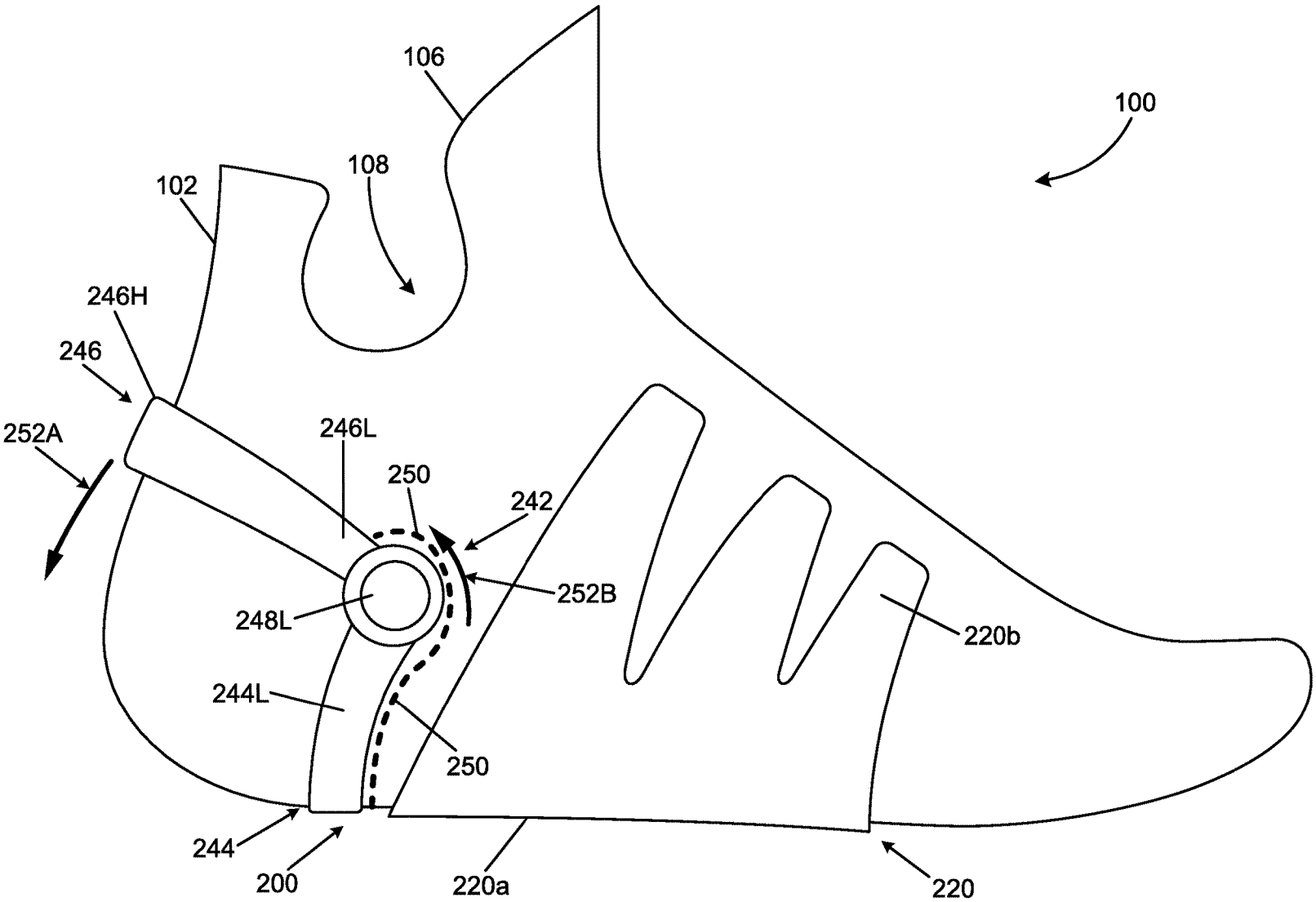
FIGS. 1A-1F provide various views of an example article of footwear including foot support systems in accordance with at least some aspects and examples of this invention.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. DETAILED DESCRIPTION OF SPECIFIC EXAMPLES OF THIS INVENTION

FIGS. 1A through 1F illustrate various views of one example article of footwear 100 and/or components thereof in accordance with some aspects of this invention. This example article of footwear 100 includes an upper 102 with various components of a foot support system 200 engaged and/or integrally formed with it (and optionally engaged and/or integrally formed with a footwear sole structure 104, which is not shown in these specific figures, but is shown in other figures). While various constructions are possible, the upper 102 (made from one or more parts) may be engaged with the sole structure 104 (made from one or more parts), e.g., in conventional manners as are known and used in the art. The upper 102 includes a foot-insertion opening 106 that provides access to an interior volume 108 configured to receive a wearer's foot. The interior volume 108 may be defined by one or both of the sole structure 104 and the upper 102. While FIGS. 1A-1E show a hightop upper 102 construction, low-top and/or other upper constructions may be used without departing from this invention.

The upper 102 and/or the sole structure 104 may have any desired structures, component parts, materials, and the like, without departing from this invention, including structures, component parts, materials and the like as are conventionally known and used in the footwear arts. Details of such conventional features will be not described in detail herein.

Figure 1B:
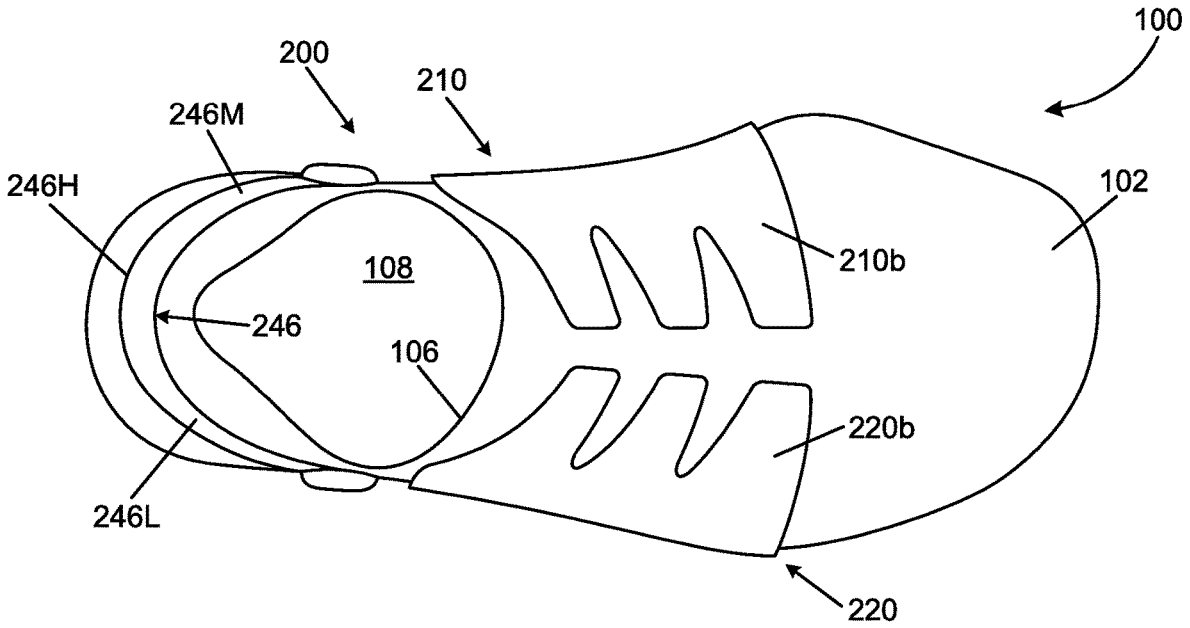
Figure 1C:
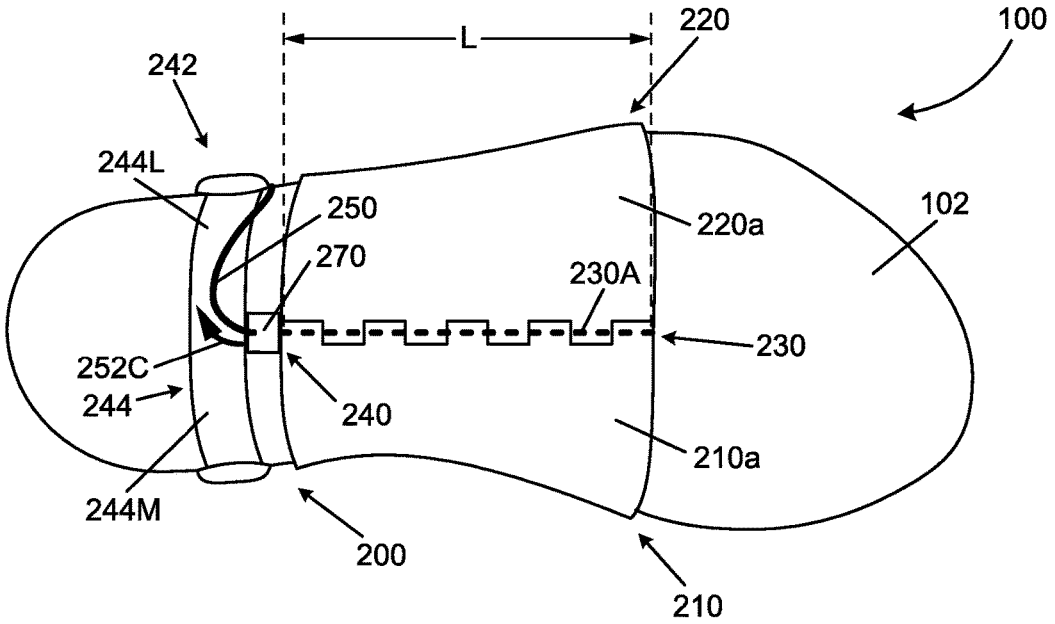
Figure 1E:
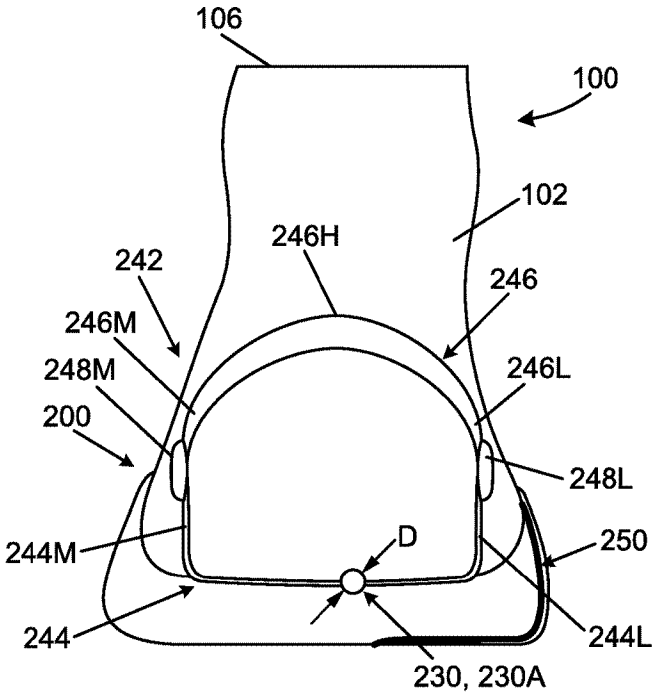
Figure 1D:
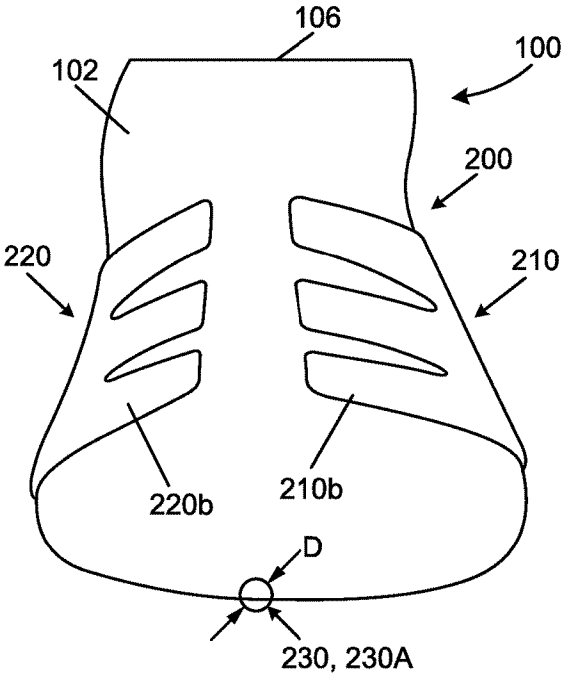
Figure 1F:
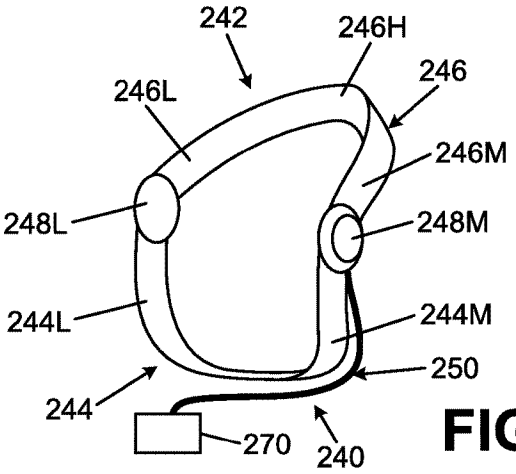

This illustrated example article of footwear 100 includes a foot support system 200 in accordance with some aspects of this invention that now will be described in more detail. The foot support system 200 includes a medial side member 210, e.g., including a medial side foot support base 210*a* and at least one medial side support 210*b* (e.g., one or more medial side support ribs) extending upward from the medial side foot support base 210*a*. This foot support system 200 further includes a lateral side member 220, e.g., including a lateral side foot support base 220*a* and at least one lateral side support 220*b* (e.g., one or more lateral side support ribs) extending upward from the lateral side foot support base 220*a*. When plural side supports 210*b*/220*b* (e.g., plural ribs) are provided in a foot support system 200, the individual side supports 210*b*/220*b* on each side may be longitudinally spaced from one another (in the front-to-back direction of the footwear 100 structure), e.g., as shown in FIGS. 1A, 1B, and 1D. The foot support system 200 may be made from any desired materials without departing from the invention, such as rigid or semi-rigid plastic materials, PEBAX® (polyether block amides available from Arkema, Inc.) or other thermoplastic elastomers, thermoplastic polyurethanes, thermosetting polymers, etc., e.g., by molding techniques (e.g., injection molding).

Foot support systems 200 of this type are capable of being moved between: (a) a foot-insertion configuration (or a foot-removal configuration) and (b) a foot-containing configuration. As some more specific examples, the medial side member 210 and the lateral side member 220 may be engaged together such that the one or more medial side support ribs (as medial side supports 210*b*) and the one or more lateral side support ribs (as lateral side supports 220*b*) are movable with respect to one another between the foot-insertion configuration and the foot-containing configuration. In the specific examples illustrated in FIGS. 1A-4B, a hinge system 230 is provided that connects the medial side member 210 (e.g., the medial side foot support base 210*a*) and the lateral side member 220 (e.g., the lateral side foot support base 220*a*) in a relative rotational manner. The hinge system 230 of this example includes a shaft 230A extending through alternating sections of the medial side base member 210*a* and the lateral side base member 220*a* in a front-to-back direction (longitudinal direction) of the article of footwear 100. The shaft 230A of this example has an axial length dimension L in the front-to-back direction (e.g., see FIG. 1C) and a diameter D (e.g., see FIGS. 1D, 1E), wherein the axial length dimension is at least three times greater than the diameter (and in some examples, at least 5 times greater, at least 10 times greater, or even at least 20 times greater).

In this illustrated example, the hinge system 230 is configured to move the foot support system 200 between the foot-insertion configuration and the foot-containing configuration. In moving from the foot-insertion configuration to the foot-containing configuration, the interior surface of the medial side member 210 (e.g., at least the interior surface(s) of medial side support(s) 210*b*) and the interior surface of the lateral side member 220 (e.g., at least the interior surface(s) of lateral side support(s) 220*b*) rotate about the hinge system 230 with respect to one another in a direction toward one another and/or in a direction toward the instep area of a wearer's foot (e.g., to close around the wearer's foot). Compare, for example, foot-insertion configuration to foot-containing configuration movement shown by FIG. 2B to FIG. 2A; FIG. 2C to FIG. 2D; FIG. 3A to 3B, and FIG. 4B to FIG. 4A). In moving from the foot-containing configuration to the foot-insertion/removal configuration, the interior surface of the medial side member 210 (e.g., at least the interior surface(s) of medial side support(s) 210*b*) and the interior surface of the lateral side member 220 (e.g., at least the interior surface(s) of lateral side support(s) 220*b*) rotate about the hinge system 230 with respect to one another in a direction away from one another and/or in a direction away from the instep area of a wearer's foot (to open up and/or move away from the wearer's foot). Compare, for example, foot-containing configuration to foot-insertion/removal configuration movement shown by FIG. 2A to FIG. 2B; FIG. 3C to 3D, and FIG. 4A to FIG. 4B).

In at least some examples of this invention, the foot support system 200 may include a locking system 240, e.g., to releasably lock the hinge system 230 and to hold the foot support system 200 in the foot-containing configuration (e.g., in the configurations shown in FIGS. 1A-1D, 2A, 2D, 3B, 3C, and 4A. Any desired type of hinge locking system 240 may be used without departing from this invention, including, for example, a physical component (such as a ratchet type system or a stopper member) that (temporarily and/or releasably) prevents the medial side foot support base 210*a* and/or the medial side support(s)/rib(s) 210*b* from rotating with respect to the lateral side foot support base 220*a* and/or the lateral side support(s)/rib(s) 220*b* to or toward the foot-insertion configuration. Additionally or alternatively, if desired, the locking system 240 may hold the foot support system 200 in the foot-insertion/foot-removing configuration and/or (temporarily and/or releasably) prevent movement of the foot support system to or toward the foot-containing configuration.

FIGS. 1A-1F illustrate various features of an example locking system 240 and release/switch system 242 for changing/switching the locking system 240 from a locked state to an unlocked state. As shown, this example release system 242 includes a base support 244, e.g., including a first side member (e.g., medial side member 244M) and a second side member (e.g., lateral side member 244L). A first lever 246 (e.g., a release actuating lever or switching lever) includes a first end (e.g., medial side end 246M) and a second end (e.g., lateral side end 246L). A first hinge (e.g., medial side hinge 248M) rotatably connects the first side member 244M of the base support 244 and the first end 246M of the first lever 246, and a second hinge (e.g., lateral side hinge 248L) rotatably connects the second side member 244L of the base support 244 and the second end 246L of the first lever 246. The first lever 246 of this example extends around a rear heel area of the upper 102/wearer's foot and forms a rear heel area 246H of the foot support system 200. As shown in these figures, the base support 244 and the lever 246 define a receptacle configured to receive and/or form a heel area of the upper 102 and are structured and arranged to contain a heel portion of a wearer's foot. The base support 244 may be engaged with the upper 102 and/or the sole 104 and/or the lever 246 may be engaged with the upper 102 and/or the sole 104.

In this illustrated example, a release cable 250 is engaged with the lever 246 at one end 246L/246M thereof, wraps around the corresponding hinge 248L/248M, extends down the corresponding side member 244L/244M and along the bottom of base support 244 to locking element 270. When a user rotates lever 246 downward (see arrow 252A in FIG. 1A), this action pulls the cable 250 further around the hinge 248L (see arrow 252B) and pulls the locking element 270 outward (see arrow 252C) to (at least temporarily) unlock the locking system 240. The locking element 270 may be spring loaded and/or otherwise biased such that: (a) when the force applied to the lever 246 to unlock the locking system 240 is sufficiently relaxed (or the lever 246 is otherwise returned to its original position) and/or the foot support system 200 is returned to the foot-containing configuration, the locking element 270 springs back to again lock the locking system 240 (and hold the foot support system 200 in the foot-containing configuration).

While FIGS. 1A-1F show the release/switching system extending around the rear heel area of the upper 102, other options are possible. For example, if desired, a single side member (244L or 244M) could be provided, engaged with a single hinge (248L or 248M), which in turn is engaged with a single lever end (246L or 246M) that does not extend completely around the rear heel area. As another alternative, the lever 246 need not extend completely around the heel area of the shoe and/or separate levers 246, hinges 248, and/or release cables 250 may be provided on each of the lateral side and medial side of the shoe 100. The lever(s) 246 could be provided at any desired location on the upper or sole structure without departing from this invention, e.g., on just the lateral side, on just the medial side, on both sides, etc. Other potential ways of moving the locking element 270 and/or otherwise unlocking the lock system 240 also could be provided without departing from this invention (including mechanical linkages and systems and/or electronically activated locking/unlocking systems).

Figure 2A:
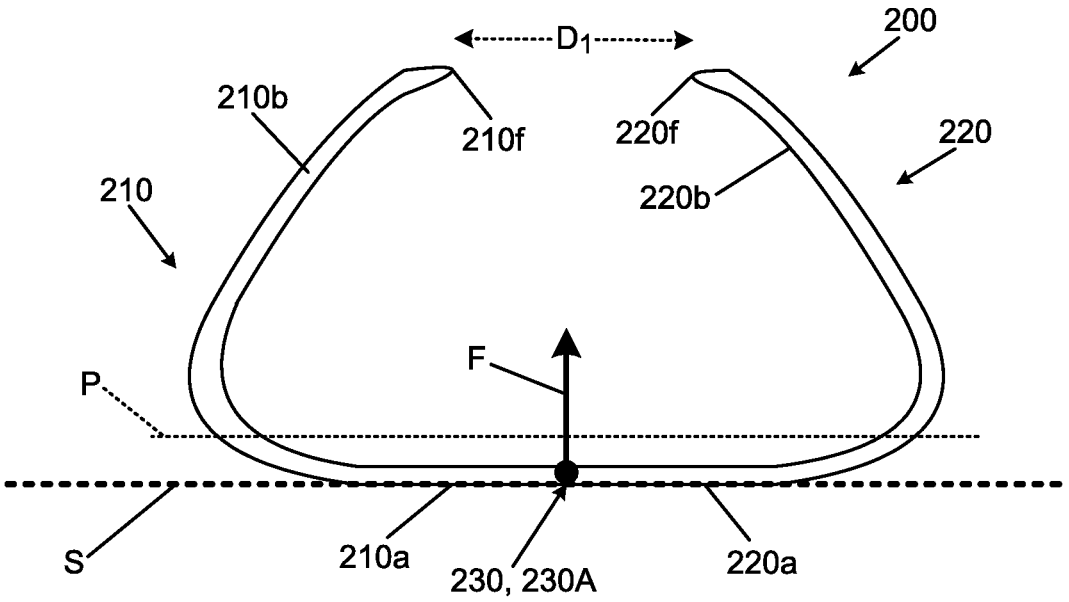
FIGS. 2A-5B illustrate various features and/or functions of examples of foot support systems and articles of footwear in accordance with at least some aspects and examples of this invention.
Figure 2B:
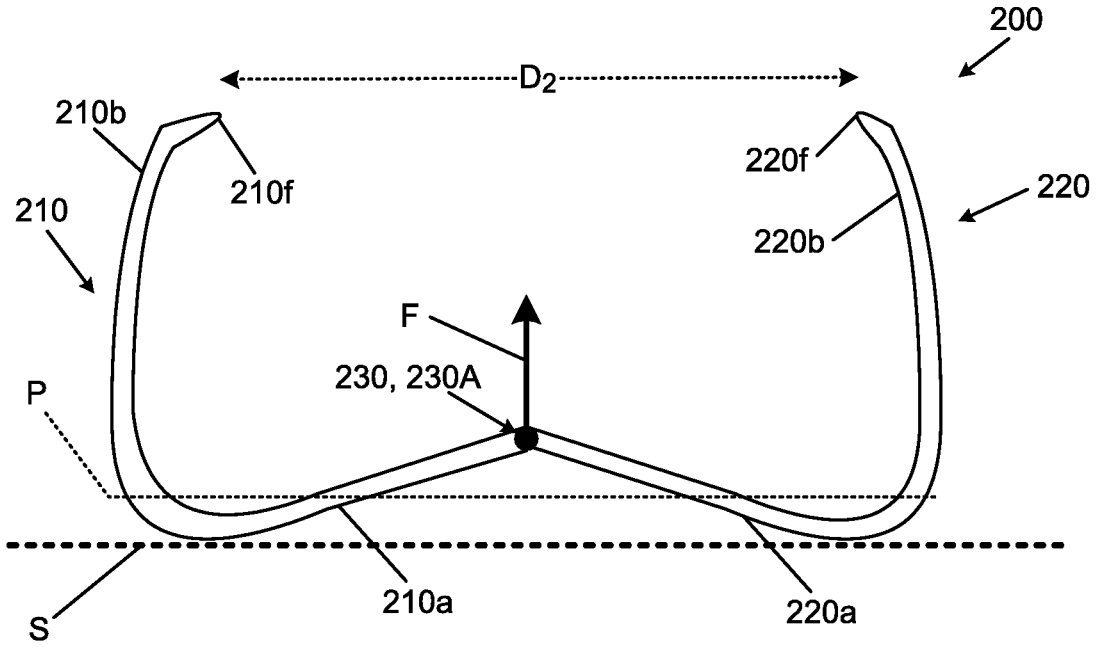
Figure 2C:
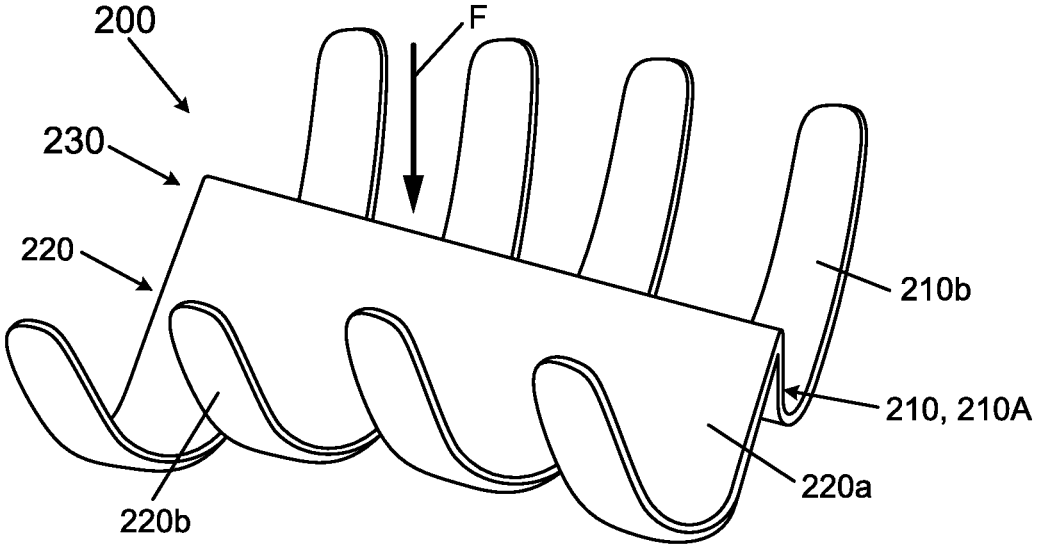
Figure 2D:
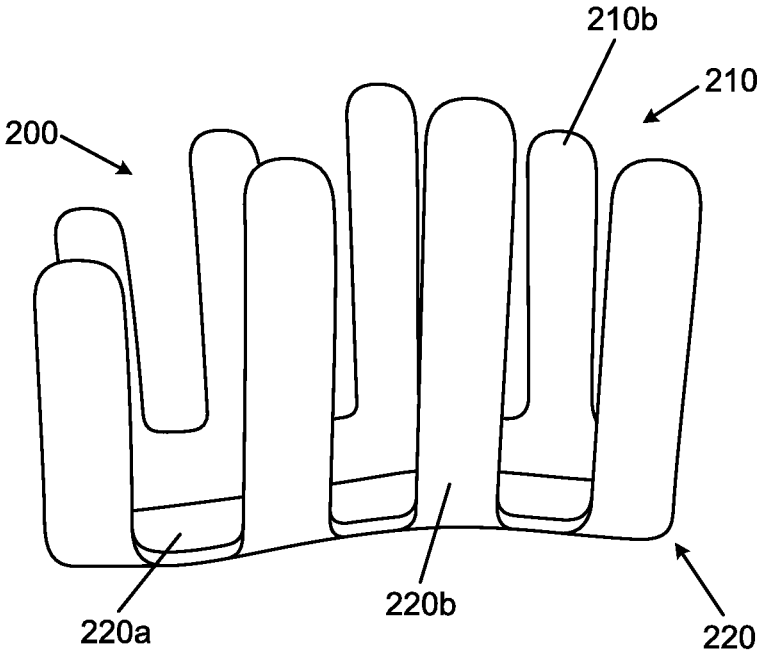

Additional or alternative potential features of some example foot support systems 200 are illustrated in FIGS. 2A-2D. For example, as shown in FIGS. 2A and 2B, with the foot support system 200 (or an article of footwear 100 containing it) supported on a horizontal support surface S, a horizontal plane P exists above the horizontal support surface S in which:

(a) in the foot-containing configuration (FIG. 2A), the entire hinge system 230 and/or the entire foot support base (e.g., the entire medial side foot support base 210*a* and/or the entire lateral side foot support base 220*a* for supporting a plantar surface of a wearer's foot) is/are located below the horizontal plane P, and (b) in the foot-insertion configuration (FIG. 2B), at least a portion of the hinge system 230 (and optionally all of the hinge system 230) and/or at least a portion of the foot support base (e.g., at least a portion of the medial side foot support base 210*a* and/or at least a portion of the lateral side foot support base 220*a* for supporting a plantar surface of a wearer's foot) is/are located above the horizontal plane P.

As further evident from these figures, in the foot-containing configuration (FIG. 2A), at least some portion(s) of the foot support base (e.g., base members 210*a*/220*a*) is/are flatter than in the foot-insertion configuration (FIG. 2B). Additionally, in the foot-insertion configuration, the central portion of the foot support base (e.g., base members 210*a*/220*a*) extends in an angled (and/or curved) manner into an area between the medial side support(s)/rib(s) 210*b* and the lateral side support(s)/rib(s) 220*b* (between the facing interior surfaces of ribs 210*a*/210*b*).

Additionally or alternatively, as also shown in FIGS. 2A and 2B, with the foot support system 200 or an article of footwear 100 containing it supported on horizontal support surface S: (a) at least a first rib 210*b* of the one or more medial side support ribs includes a free end 210*f* that extends to a location over the foot support base (e.g., over one or more of the hinge system 230, the medial side foot support base 210*a*, the lateral side foot support base 220*a*, and/or an instep area of a wearer's foot), and (b) a first rib 220*b* of the one or more lateral side support ribs includes a free end 220*f* that extends to a location over the foot support base (e.g., over one or more of the hinge system 230, the medial side foot support base 210*a*, the lateral side foot support base 220*a*, and/or an instep area of a wearer's foot). In the foot-insertion configuration (FIG. 2B), the free end 210*f* of support rib 210*b* is located a distance $D_2$ from the free end 220*f* of support rib 220*b*, and in the foot-containing configuration FIG. 2A, the free end 210*f* of support rib 210*b* is located a distance $D_1$ from the free end 220*f* of support rib 220*b*, wherein $D_2>D_1$. As some more specific examples, $D_2$ may be 1.5 times $D_1$, 2 times $D_1$, 2.5 times $D_1$, or even 3 times $D_1$.

FIGS. 2C and 2D provide side/perspective views showing transition of this example foot support system 200 from the foot-insertion configuration (FIG. 2C) to the foot-containing configuration (FIG. 2D). As evident from a comparison of these figures, when a downward force F is applied to the foot support system 200 (e.g., to base portions 210*a*/220*a* and/or hinge 230), the base flattens out from its original angular configuration and the side ribs 210*b*/220*b* rotate toward one another to close (e.g., around a wearer's foot). The ribs 210*b*/220*b* and base portions 210*a*/220*a* may move, for example, in the manner generally shown in the rear views of FIGS. 2A and 2B.

Footwear 100 and foot support systems 200 according to examples of this invention may move between the foot-insertion configuration and the foot-containing configuration and between the foot-containing configuration and the foot-removal configuration in any desired manners without departing from this invention. As one example, a user may physically grasp one or both of the side support member/ribs 210*b*/220*b* and rotate them toward/away from one another to close/open the foot support systems 200. As another example, one foot can move lever 246 on the other shoe to unlock the locking system 240 and/or hold down the rear of the shoe 100, and then motion of the user's instep against the support member/ribs 210*b*/220*b* can open up the support system 200. As an additional or alternative feature, the foot support system 200 and/or the article of footwear 100 may include a biasing system, e.g., to bias the foot support system 200 to the foot-insertion configuration when no foot is present in the foot support system 200. The biasing system may include, for example, a spring member that produces a rotational force to bias the hinge 230 to move to the foot-insertion configuration.

As other examples of this aspect of the invention, e.g., with the foot support system 200/article of footwear 100 supported on a horizontal support surface S, a biasing system may apply an upward force F to at least one member selected from the group consisting of: the hinge system 230 and/or the foot support base (e.g., the medial side foot support base 210*a* and/or the lateral side foot support base 220*a*). This upward force F, as shown schematically in FIGS. 2A and 2B, will tend to hold the foot support system 200 in the foot-insertion configuration (FIG. 2B).

FIGS. 3A-3D illustrate rear views of an example of such a biasing system 300, e.g., incorporated into a sole structure 104 of an article of footwear 100. This example biasing system 300 includes a resilient member, such as a spring member 300A, having at least a portion located beneath one or more of the hinge system 230, the medial side foot support base 210*a*, and/or the lateral side foot support base 220*a*. The spring member 300A may be engaged with or at least partially housed in the footwear sole structure 104. The spring member 300A is sized and configured such that it exerts force F on one or more of the medial side member 210, the lateral side member 220, or the hinge system 230. When no foot 1000 is present in the foot support member 200, this force F causes the medial side member 210 and the lateral side member 220 to rotate about the hinge system 230 with respect to one another to open up the foot support system 200 (and make the interior sides/surfaces and/or side supports/ribs 210*b*/220*b* thereof rotate in the direction away from one another). While these figures show biasing member 300 as a coil spring 300A, other resilient members may be used, such as a compressible foam member, a fluid-filled bladder, other types of springs, etc.

Figure 3A:
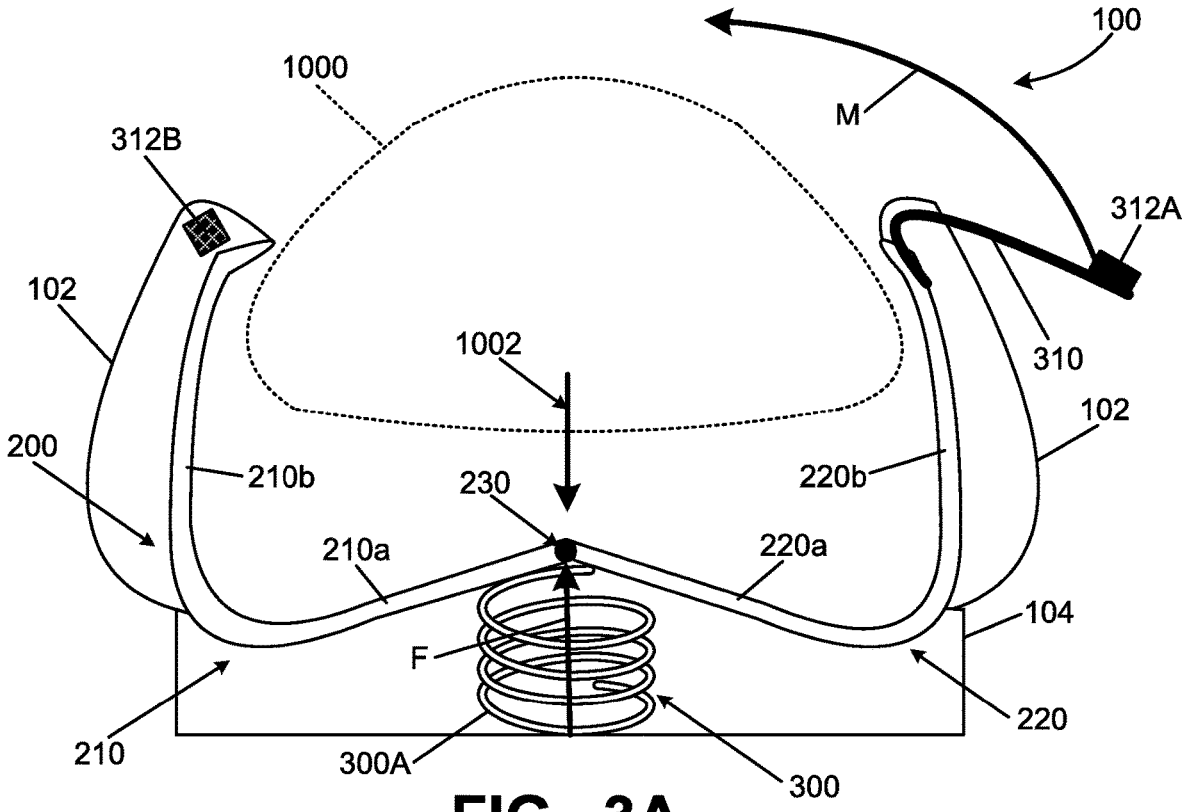

Operation of this example foot-support system 200 now will be described in more detail with reference to FIGS. 3A-3D. As shown in FIG. 3A, with the foot support system 200 biased into the foot-insertion configuration by spring member 300A, a wearer begins to insert his/her foot 1000 into the foot support system 200, as shown by arrow 1002. When the force of the wearer's foot 1002 entering the foot support system 200 overcomes the biasing force F of the spring 300A, the foot support system 200 rotates to the foot-containing configuration (FIG. 3B), e.g., by rotation of the foot support base members 210*a*/210*b* with respect to one another thereby flattening out (e.g., becoming more horizontal) and closing around the wearer's foot 1000, e.g., as described above.

Figure 3B:
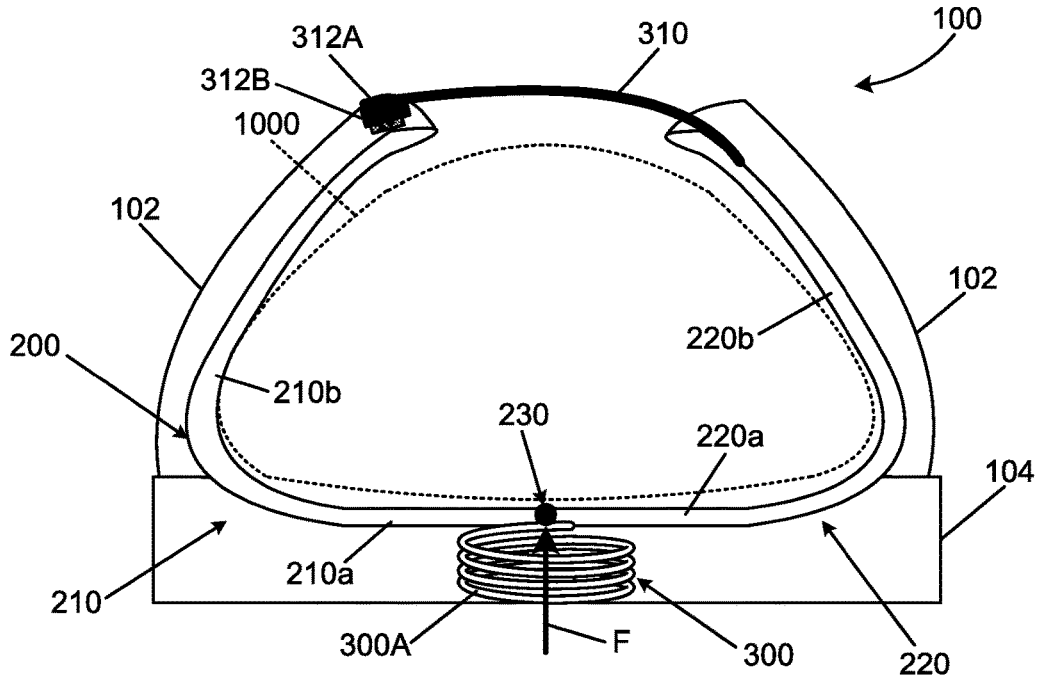

Once in the foot-containing configuration (e.g., FIG. 3B), one or more securing members 310 may be engaged, e.g., to releasably secure the medial side support(s) 210*b* with the lateral side support(s) 220*b*. As a more specific example, as shown in FIGS. 3A-3B, the securing member 310 may include a strap extending between at least one lateral side support/rib 220*b* and at least one medial side support/rib 210*b*. The securing member 310 may be engaged directly with the support/ribs 210*b*/220*b* and/or with portions of the upper 102, e.g., located adjacent support/ribs 210*b*/220*b*. Additionally or alternatively, the securing system 310 may releasably hold the medial side support(s)/rib(s) 210*b* in place with respect to the medial side foot support base 210*a* and/or may releasably hold the lateral side support(s)/rib(s) 220*b* in place with respect to the lateral side foot support base 220*a* when the foot support system 200 is in the foot-containing configuration (FIG. 3B). One, two, or more straps may be provided to engage and secure one, two, or more of the medial side supports/ribs 210*b* with (or with respect to) one, two, or more of the lateral side supports/ribs 220*b*.

The securing member(s) 310 may be releasably engaged at the foot-containing configuration in any desired manner(s) without departing from this invention, including using any desired type(s) of fasteners. In this illustrated example, the strap is releasably secured by magnetic attraction forces, e.g., through use of a magnet or a ferromagnetic material 312A as part of the strap and a corresponding magnet or a ferromagnetic material 312B at the opposite side of the upper 102. As another option, parts 312A and 312B may constitute engaging portions of a hook-and-loop fastener system. As yet other options, parts 312A and 312B may constitute joining portions of a snap, buckle connector, button connector, or the like. Any desired number of securing systems 310 of the same or different types may be provided in a footwear structure, without departing from this invention.

In at least some examples of this invention, the securing member 310 may include a strap or strip of a resiliently flexible/semi-rigid plastic material (such as PEBAX® (polyether block amides available from Arkema, Inc.) or other thermoplastic elastomers, thermoplastic polyurethanes, thermosetting polymers, etc.). If desired, the strap and the securing member 312A may be structured and weighted such that: (a) the force 1002 applied as the wearer's foot 1000 is inserted and the relative inward rotation and momentum of the side support(s)/rib(s) 220*b* created in moving from the foot-insertion configuration to the foot-containing configuration, in at least some instances, (b) will cause sufficient momentum (see arrow M) on the securing member 310 strap to automatically "sling" securing member component 312A across the top/instep of the wearer's foot 1000 to be engaged with securing member component 312B (e.g., by magnetic forces). In this manner, in at least some instances, the wearer's foot 1000 could be engaged and secured in the foot support system 200 in a "hands free" manner. Additionally or alternatively, if desired, the strap(s) 310 could be manually secured by hand.

Figure 3C:
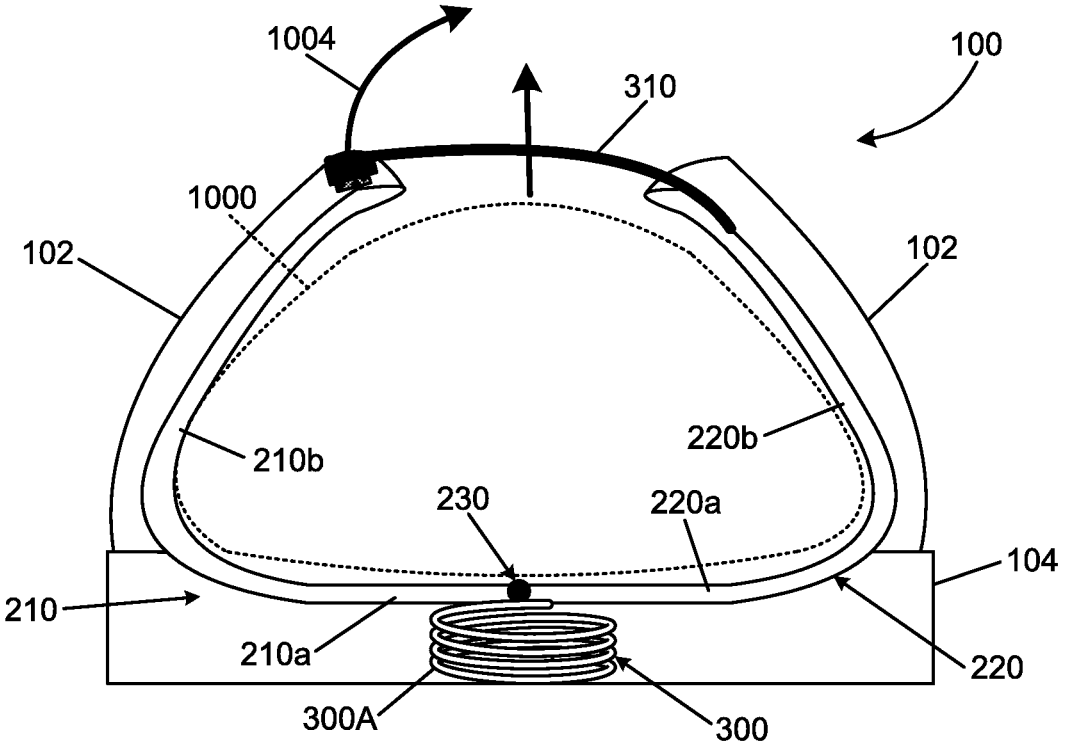
Figure 3D:
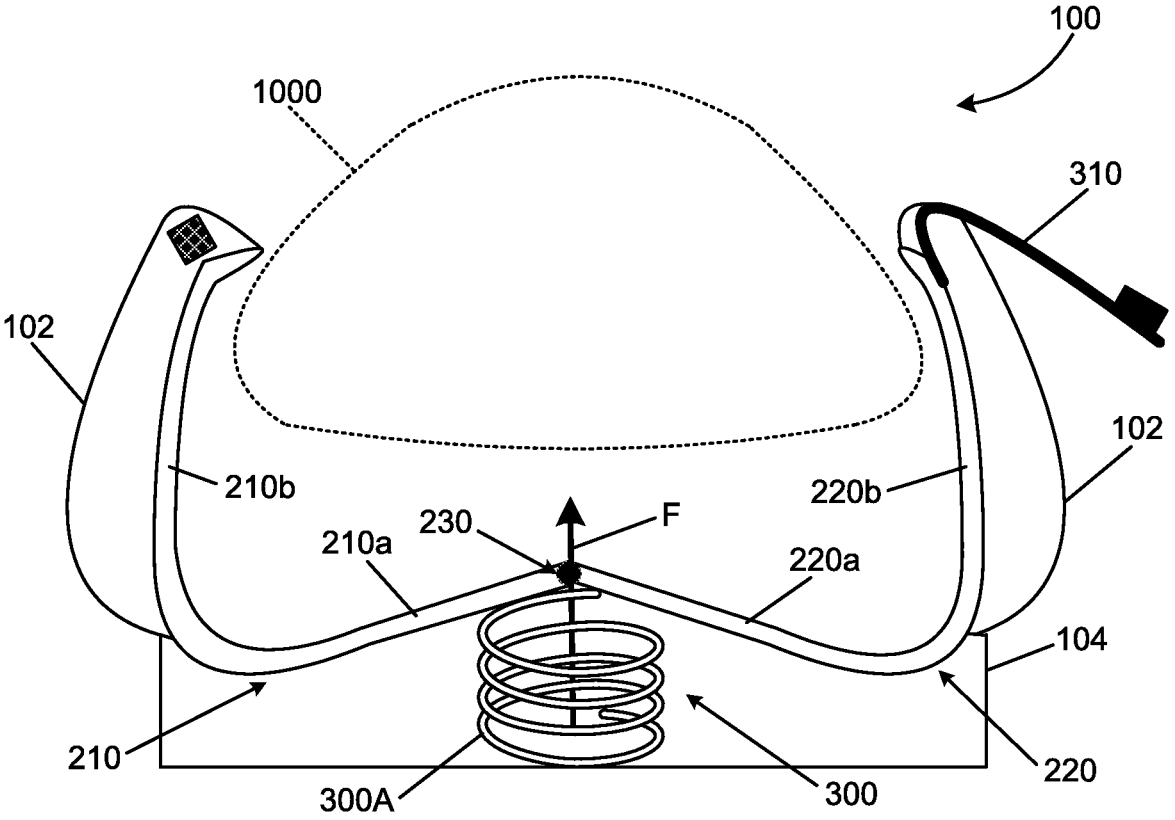

To remove the wearer's foot 1000 from the foot support system 200, in this illustrated example, the securing member 310 is released by disengaging components 312A/312B, as shown by arrow 1004 in FIG. 3C. Optionally, if necessary, a user can manually rotate the upper 102/side supports 210*b*/220*b* open. Additionally or alternatively, as the foot 1000 is lifted up and out of the shoe and weight/force is reduced on the base members 210*a*/220*a* (e.g., if the wearer sits on a chair or lifts the foot), the biasing system 300 will push the base members 210*a*/220*a* and/or hinge system 230 upward, thereby at least helping to rotate the foot support system 200 open and holding it in the open condition (in the foot-removal and/or foot-insertion configuration, FIG. 3D). In some examples of this invention, the force of biasing system 300 will be sufficient, on its own, to open the foot support system 200 (e.g., without the need for a user to rotate the side supports 210*b*/220*b* open).

While the securing system 310 can be opened as a result of manually releasing the securing member 310 (e.g., by a wearer interacting with the strap and/or securing member components 312A/312B), it alternatively could be opened in a somewhat "automatic" and/or "hands free" manner. For example, releasing the locking system 240 described above (e.g., activating lever 246 by a wearer's foot to move cable 250 and locking element 270) to unlock hinge system 230 may allow the biasing system 300 to generate sufficient upward force F to overcome magnetic forces of securing system components 312A/312B and open the securing system 310 (and open the foot support system 200).

Figure 4A:
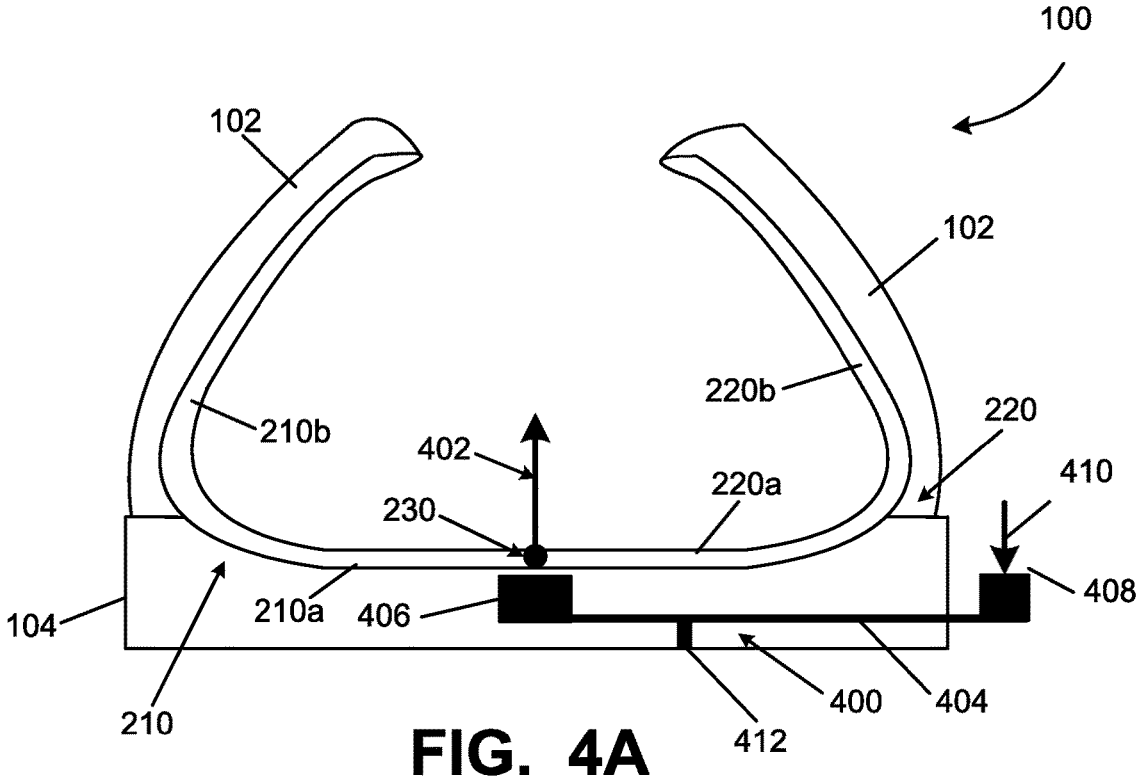
Figure 4B:
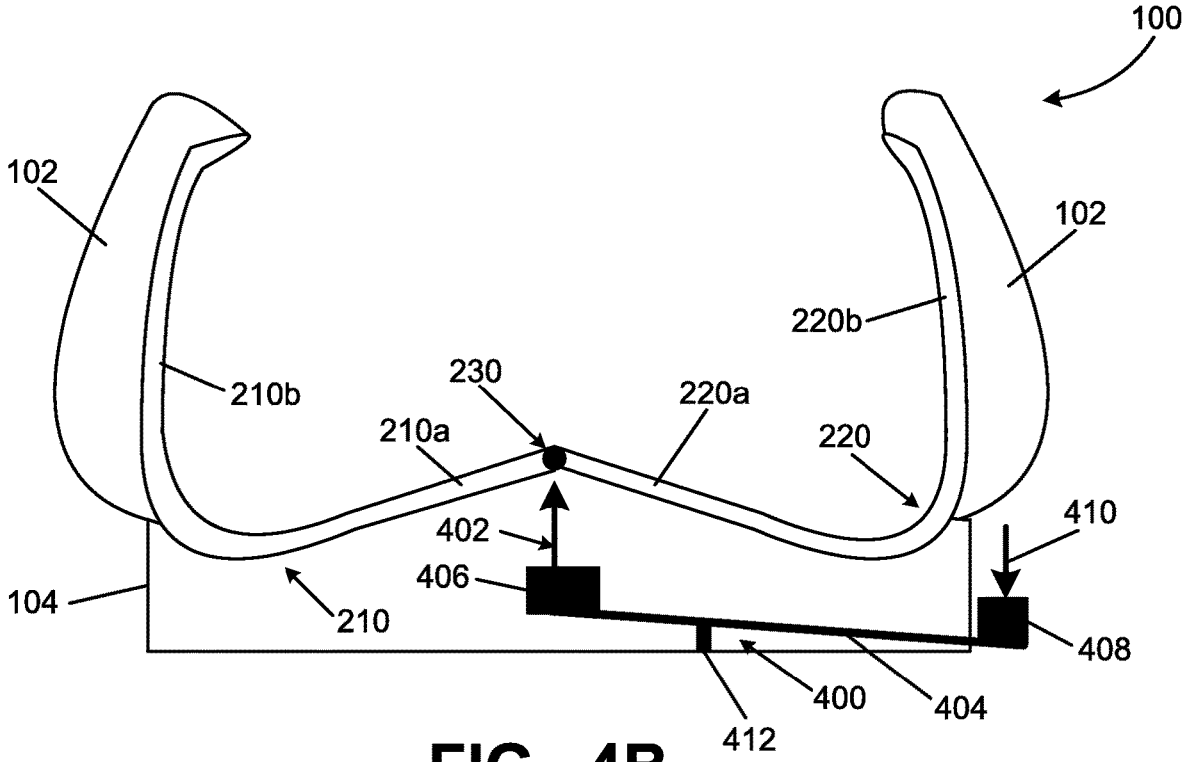

Other ways of opening or changing the foot support system 200 from the foot-containing configuration to the foot-removal/foot-insertion configuration are possible. For example, FIGS. 4A and 4B illustrate an example switch system 400 that may be used for this purpose. This switch system 400 applies an upward force 402, e.g., to at least one of: the hinge system 230, the medial side foot support base 210*a*, and/or the lateral side foot support base 220*a*. More specifically, this illustrated example switch system 400 includes a lever 404 having a force applying part or movable part 406 located beneath one or more of the hinge system 230, the medial side foot support base 210*a*, and/or the lateral side foot support base 220*a*. An external command receiving part or input part 408 is provided, e.g., at a location exposed at an exterior of the article of footwear 100 (such as at the rear or side of the sole 104), for receiving an external switching force/command 410, such as physical force applied by a wearer's foot or hand. The external switching force/command 410 applied to the command receiving part 408 of the lever 404 causes the first/movable part 406 of the lever 404 to move (e.g., upward), by rotation on fulcrum 412, and apply an upward force 402 to at least one of the hinge system 230, the medial side foot support base 210*a*, and the lateral side foot support base 220*a*. This force 402 may overcome any existing "locking force" in the hinge system 230 and move the foot support system 200 to the foot-insertion configuration (as shown by a comparison of FIGS. 4A and 4B) (e.g., move the medial side support(s)/rib(s) 210*b* with respect to the lateral side support(s)/rib(s) 220*b* from the foot-containing configuration (FIG. 4A) to the foot-insertion or foot-removing configuration (FIG. 4B).

Rather than a strictly mechanical switching system (e.g., a lever 404/fulcrum 412), the switch system 400 could include one or more electronic components. More specifically, the input part 408 could include a physical button or wireless transceiver that receives input from a user (e.g., via a button "push," a wireless transmission, from a phone "app," etc.) and element 404 could constitute wiring or circuitry connected to an electronic component 406 that, when activated, applies force 402 to at least one of the hinge system 230, the medial side foot support base 210*a*, and the lateral side foot support base 220*a*. No fulcrum 412 would be needed in this type of electronic switching configuration.

Figure 5A:
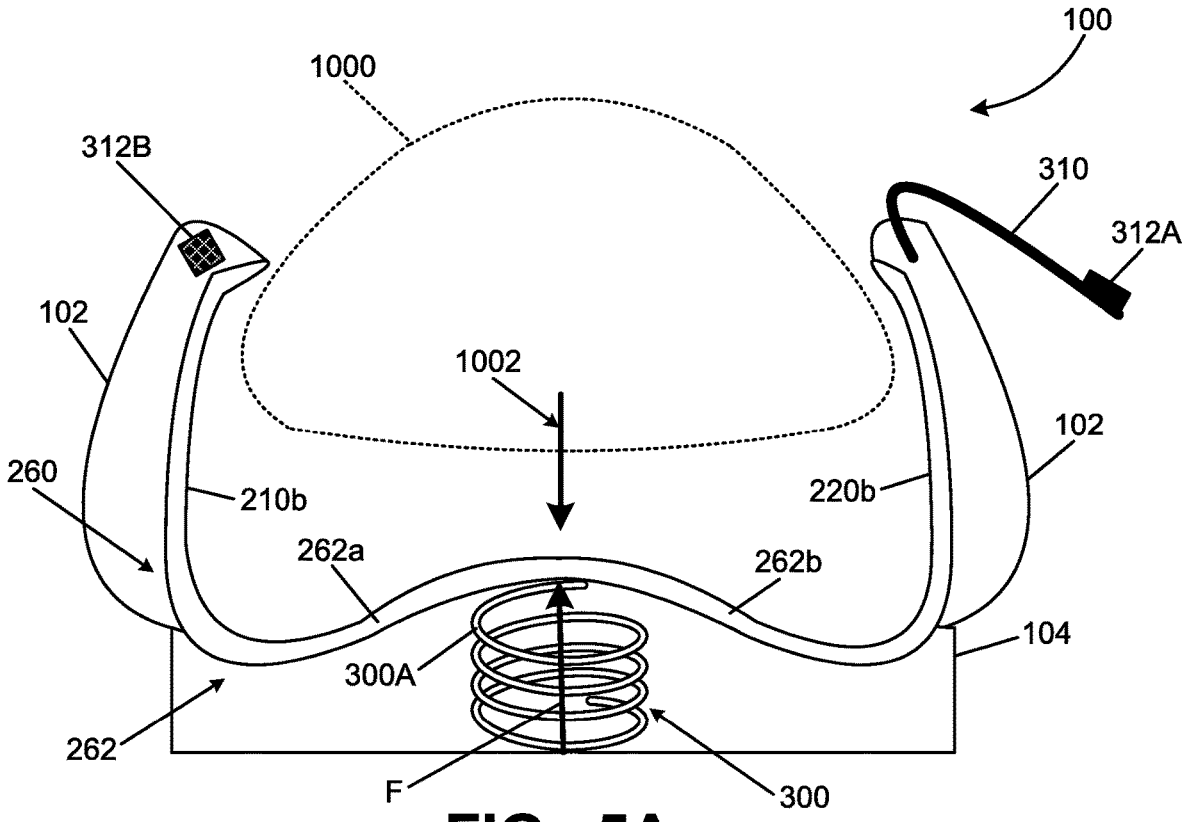
Figure 5B:
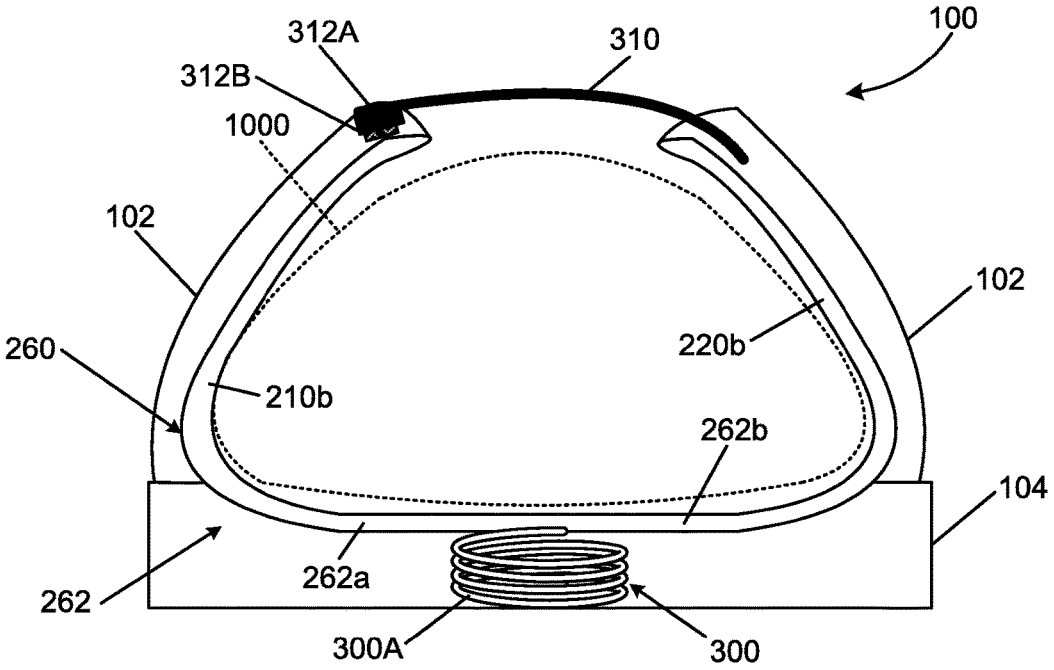

FIGS. 5A and 5B show additional or alternative potential options and features that may be provided in footwear 100/foot support systems 260 in accordance with some examples of this invention. The footwear 100/foot support system 260 of FIGS. 5A and 5B are similar to those shown in FIGS. 3A and 3B, and a repetitive discussion of the same or similar parts is omitted. One difference between the foot support system 260 of FIGS. 5A and 5B as compared to the foot support system 200 of FIGS. 3A and 3B relates to the foot support bases thereof. In the foot support system 260 of FIGS. 5A and 5B, the hinge system 230 is omitted, and the foot support base 262 includes the medial side foot support base 262*a* and the lateral side foot support base 262*b* made as a single, continuous part. This foot support base 262 may be formed of a flexible, semi-rigid plastic material (e.g., from PEBAX® (polyether block amides available from Arkema, Inc.) or other thermoplastic elastomers, thermoplastic polyurethanes, thermosetting polymers, etc.). The force of a biasing system 300 of the types described above (e.g., spring 300A, an electronically activated system, a lever system, etc.) may deform the support base 262 and move the foot support system 260 between the foot-containing configuration (FIG. 5B) and the foot-insertion configuration (FIG. 5A). As shown in FIGS. 5A and 5B, in the foot-insertion configuration, this example foot support base 262 extends in a curved manner into an area between the medial side support(s)/rib(s) 210*b* and the lateral side support(s)/rib(s) 220*b*. The foot support base 262 is flatter in the foot-containing configuration (FIG. 5B) than it is in the foot-insertion configuration (FIG. 5A). This foot support system 260 could be incorporated into any desired type of article of footwear and/or used with any desired type of biasing system and/or switching system, e.g., of the various types described above.

Various additional or alternative features of foot support systems and/or articles of footwear 600 in accordance with at least some examples of this invention are shown in FIGS. 6A-6D. This example article of footwear 600 includes an upper 602 and a sole structure 604 engaged with the upper 602. The sole structure 604 includes a forefoot support portion 604F, a heel support portion 604H, a midfoot support portion 604M located between the forefoot support portion 604F and the heel support portion 604H, a lateral side 604L, and a medial side 6041. As further shown from a comparison of FIGS. 6A and 6B, in this illustrated footwear structure 600, the heel support portion 604H is rotatable with respect to the forefoot support portion 604F on an axis 604A located in the midfoot support portion 604M. This rotational axis 604A extends from the lateral side 604L to the medial side 6041 of the sole structure 604. In this manner, the rear heel portion 604H of the sole structure 604 and the rear heel area of the upper 602 may be rotated with respect to forefoot support portion 604F of the sole structure 604 so that the rear heel area of the foot-receiving chamber of the shoe 600 is opened up to allow easy insertion of a wearer's forefoot into the shoe 600 from the rear side of the upper 602's forefoot area.

Any desired manner of providing the axis 604A of rotation may be used, including, for example, incorporating a physical axle or hinge structure into the sole structure 604, making the sole structure 604 of a "thinner" material at the desired rotational location, etc. As some more specific examples, a rotational axis 604A may be provided, for example, in the various manners shown and described in U.S. Pat. Nos. 474,574, 5,184,410, 5,481,814, 6,189,239, 8,161,669, and 8,245,421; U.S. Patent Appln. Publn. No. 2014/0298687 A1; and/or PCT Publn. No. WO2014/033396 A1 and/or WO 2014/140443. Each of these patents and patent publications is entirely incorporated herein by reference. The upper 602 may include gaps, discontinuities, stretchable materials, or other structures to support rotation on axis 604A.

Sole structures 604 of this type, with a transverse (lateral side-to-medial side) axis 604A may be used, if desired, along with foot support systems 200/260 of the various types described above, e.g., in conjunction with FIGS. 1A-5B. In this manner, in addition to opening up from the rear heel area and rotating open about transverse axis 604A, the article of footwear/foot support system 200/260 also can open up about a longitudinal axis (e.g. 230A) to provide still easier access for a wearer's foot to the footwear 600's interior chamber and easy securing of the shoe 600 to the foot. The foot support system 200/260 can close around the wearer's foot, e.g., in the manners described above, as the wearer dons the shoe 600.

As a more specific example, in the footwear structure 600 of FIGS. 6A-6D, at least a portion of the foot support system (e.g., the medial side support(s)/rib(s) 210*b* and/or the lateral side support(s)/rib(s) 220*b*) may be located rearward of the axis 604A. The lateral side support(s)/rib(s) 220*b* are shown in broken lines in FIG. 6A as they are contained within or beneath the lateral side securing flap 610L of upper 602, which will be described in more detail below. The medial side securing flap 610M of upper 602 may include a mirror image of support(s)/rib(s) 210*b* or other similar structures to side supports/ribs 220*b* shown in FIG. 6A. The plantar support base surface(s) 210*a*/220*a*/262*a* of foot supports 200/260 are provided rearward of axis 604A in this illustrated example.

Figure 6A:
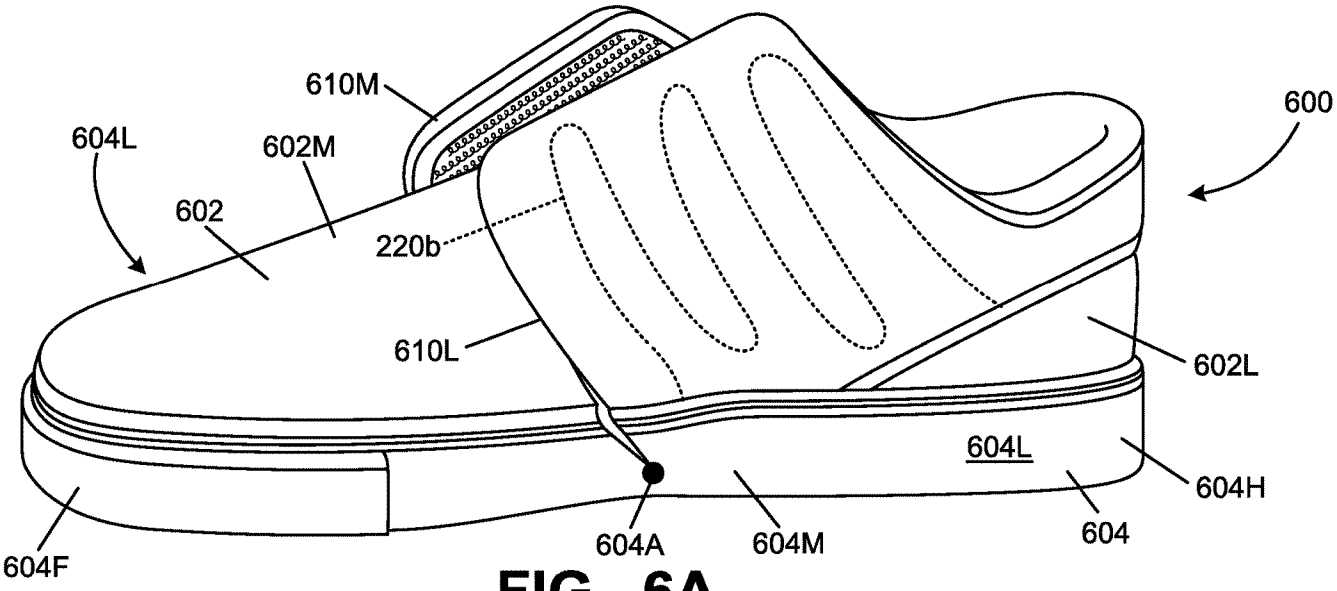
FIGS. 6A-7D illustrate various features and/or functions of examples of articles of footwear in accordance with at least some aspects and examples of this invention.
Figure 6B:
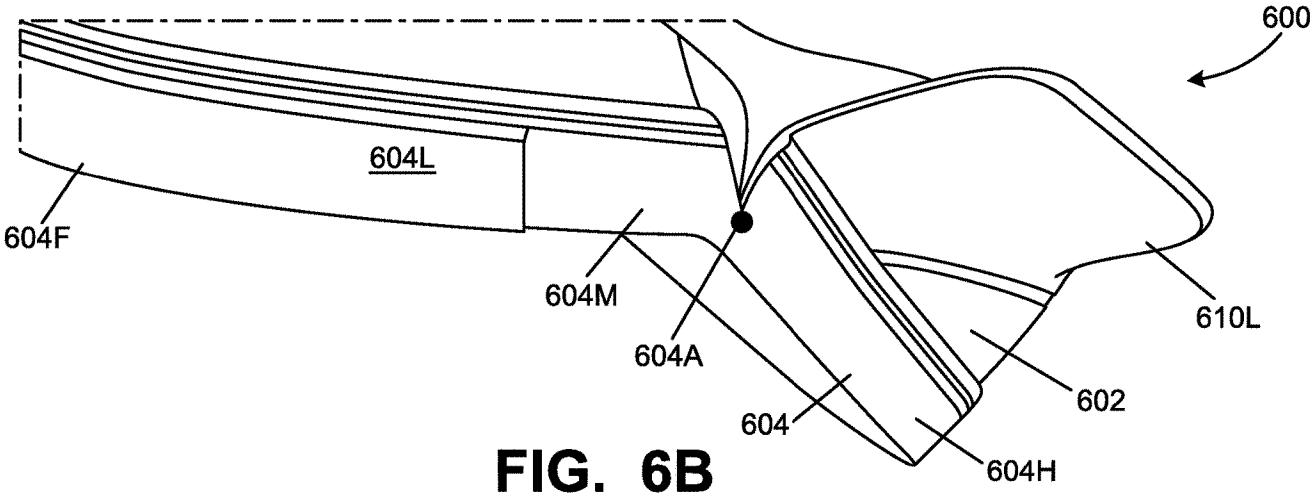
Figure 6C:
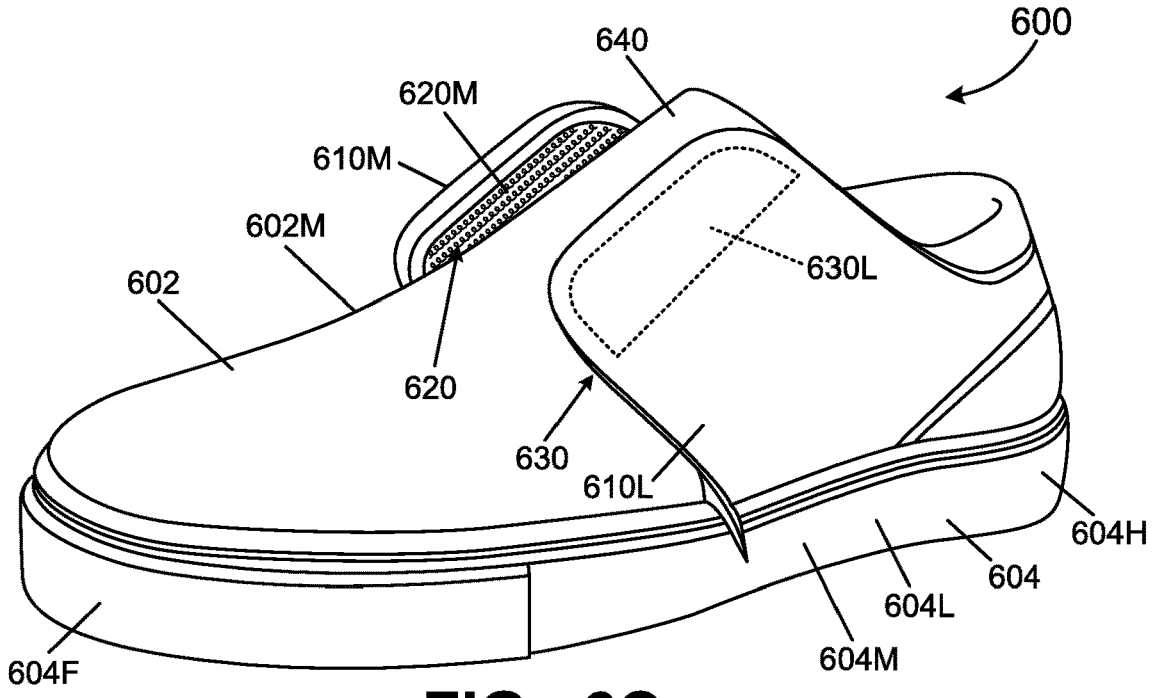
Figure 6D:
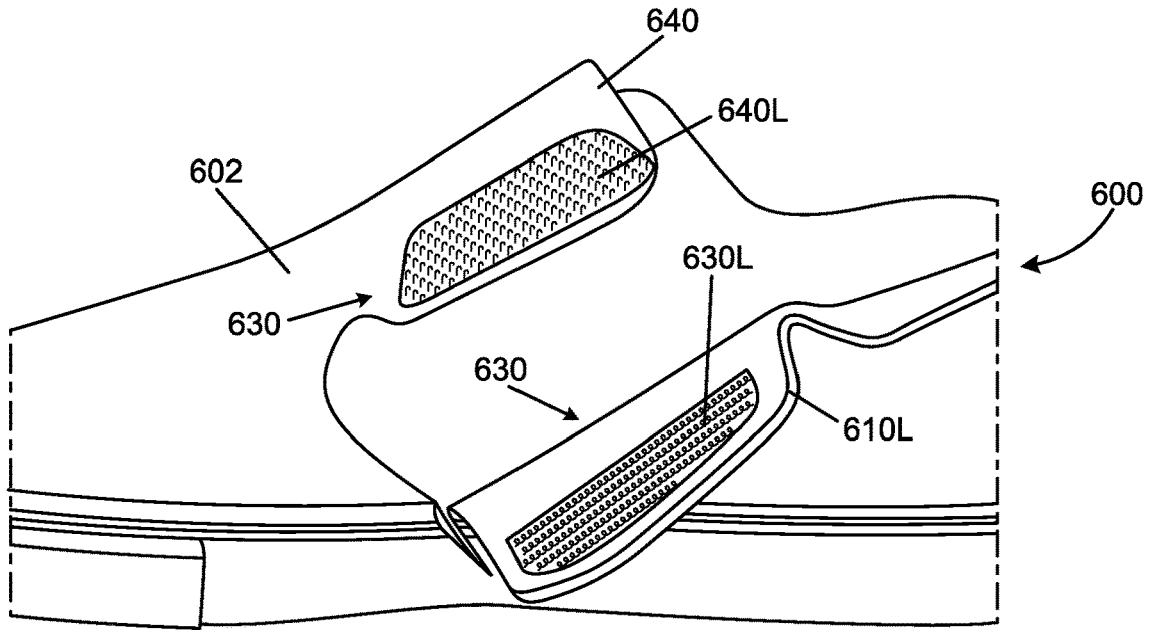

As further shown in FIGS. 6C and 6D, the medial side 602M of the upper 602 includes a portion 620M of a medial side securing system 620 for securing the upper 602 to a wearer's foot, and the lateral side 602L of the upper 602 also includes a portion 630L of another securing system 630 for securing the upper 602 to a wearer's foot. In this example, the upper 602 includes a vamp portion 640 (e.g., across a top, front, and/or instep area of a wearer's foot), which may include a footwear tongue component. The upper 602 vamp portion 640 may include other portion(s) of the securing systems 620/630. More specifically, a lateral side securing component 640L is shown in FIG. 6D (for engaging lateral side securing component 630L on the lateral flap 610L), and a similar medial side securing component could be provided on the other side of vamp 640 for engaging the medial side securing component 620M on medial flap 610M. Alternatively, if desired, securing component 640L on the vamp 640 could be sized and shaped so that it could be engaged by both the securing components 620M and 630L on the medial flap 610M and lateral flap 610L, respectively. While other securing systems and/or fasteners may be used (including securing systems and fasteners conventionally known and used in the footwear arts, such as buckles, snaps, buttons, etc.), in this illustrated example, securing portions 620M, 630L, and 640L are portions of hook-and-loop fastener systems (for releasably engaging the upper 602 to a wearer's foot in the midfoot area).

FIGS. 7A-7D illustrate various views of another example article of footwear 700 in accordance with at least some examples of this invention. The footwear 700 of FIGS. 7A-7D is similar to that of FIGS. 6A-6D (including transverse axis 604A and an integrated foot support system 200/260), and similar parts and the like will not be described in detail.

Figure 7A:
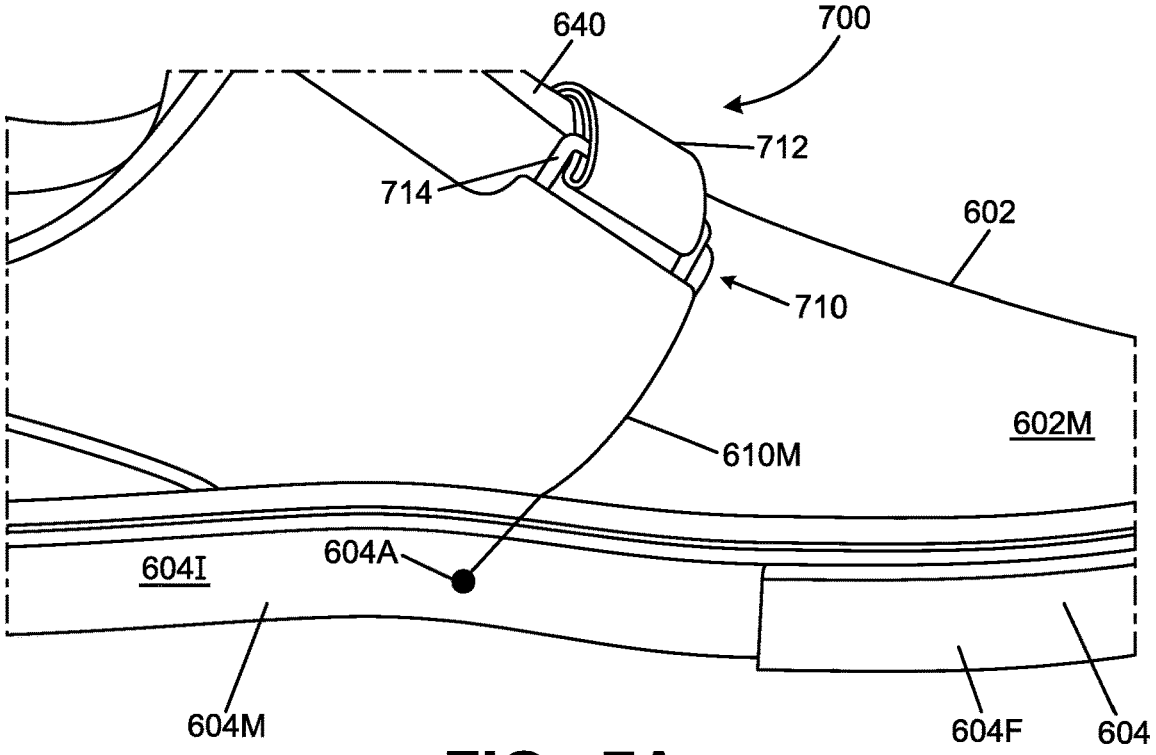
Figure 7B:
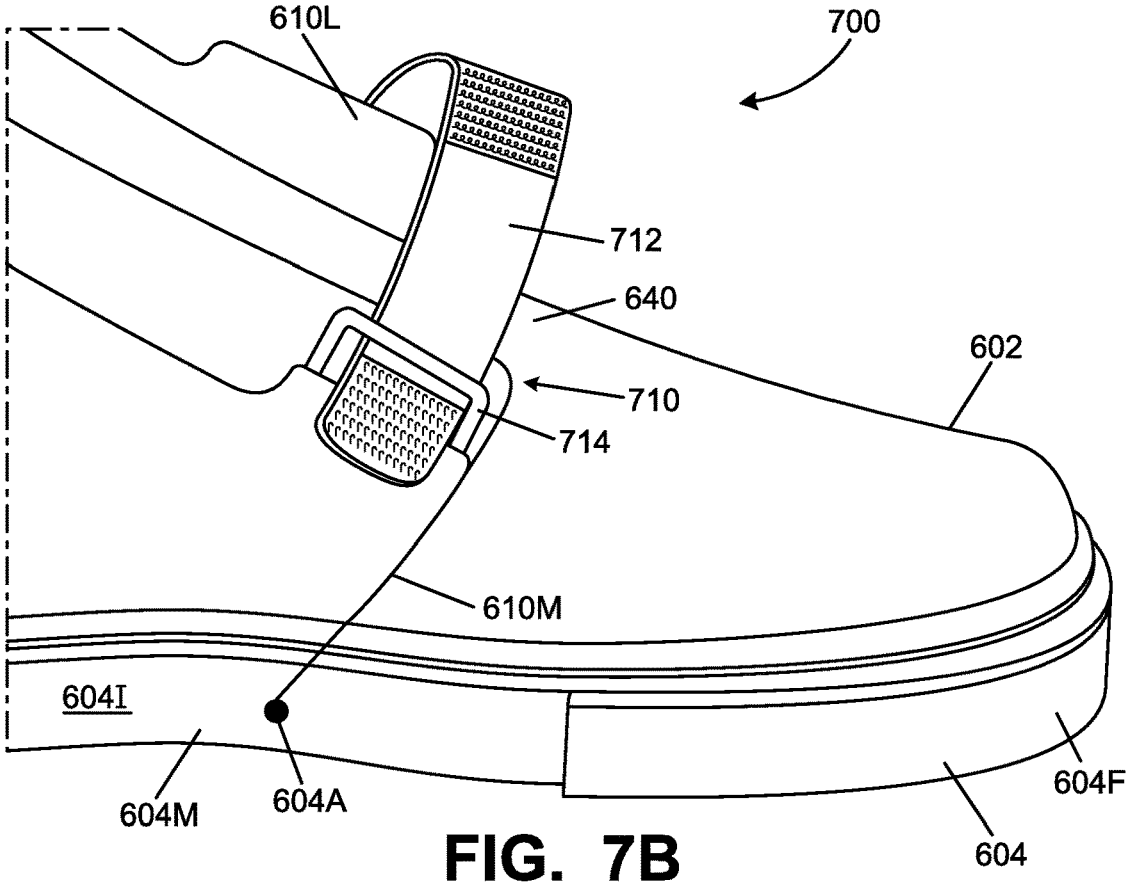
Figure 7C:
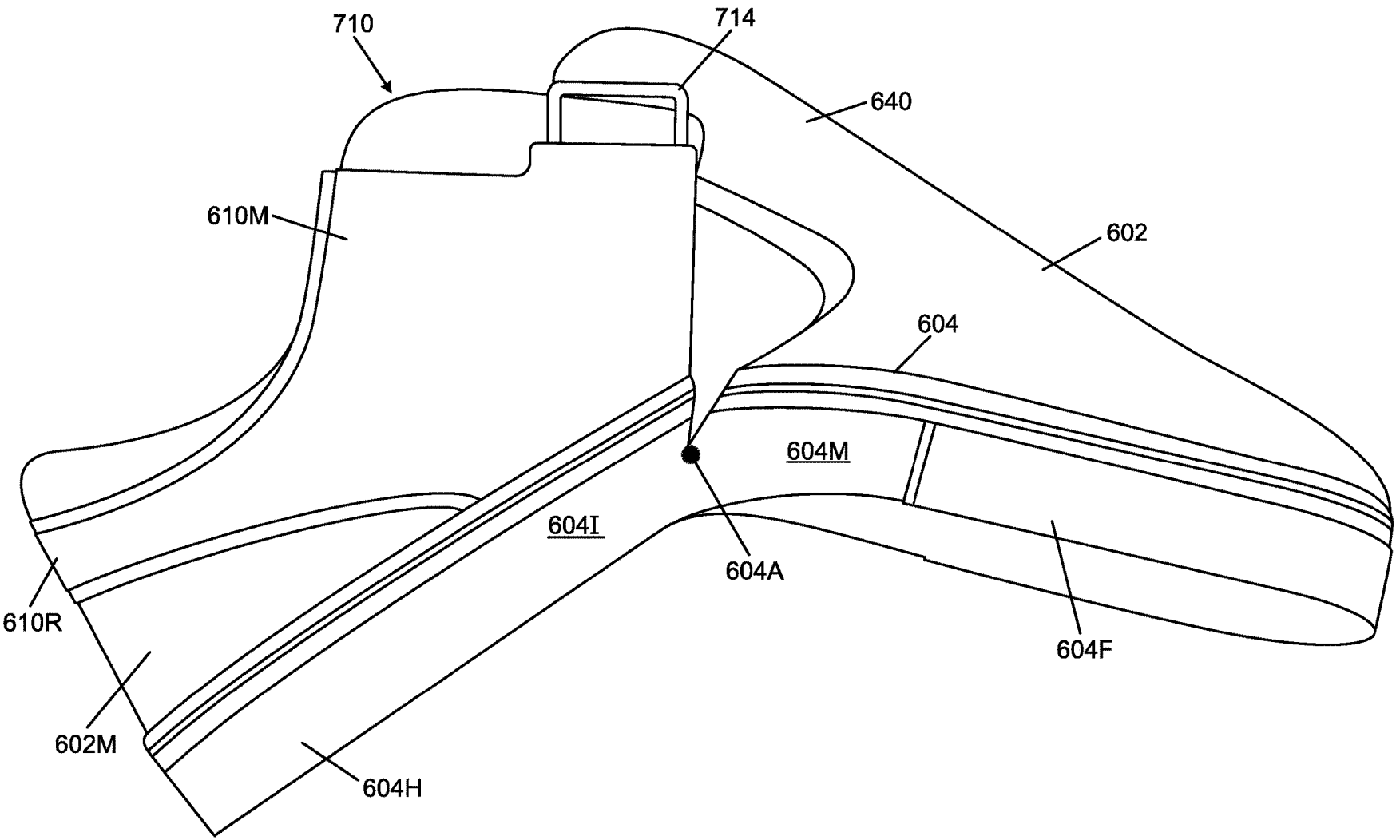
Figure 7D:
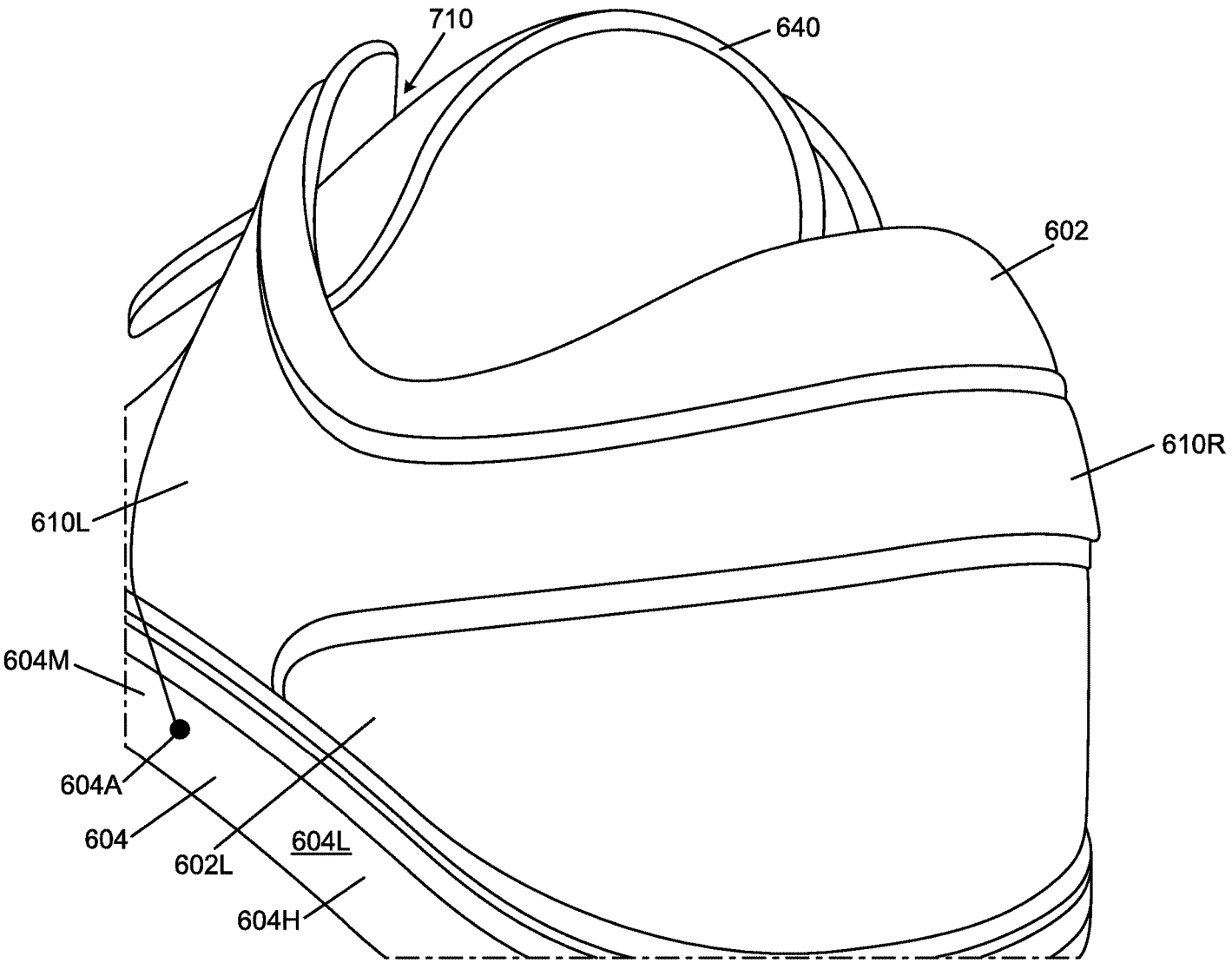

One difference between the article of footwear 600 of FIGS. 6A-6D and the article of footwear 700 of FIGS. 7A-7D relates to the securing system 710 for securing flaps 610M and 610L. More specifically, this example securing system 710 includes a strap 712 (e.g., engaged with the lateral side flap 610L) and a tensioning element 714 (e.g., a tensioning ring engaged with the medial side flap 610M). As shown in FIGS. 7A and 7B, the strap 712 passes through the tensioning device 714, doubles back over itself (e.g., across the top, vamp/forefoot portion 640 of the upper 602), and secures to itself or to another part of the upper (e.g., by a hook-and-loop fastener system, snap, buckle, button, etc.) to thereby tighten the flaps 610M/610L around the wearer's foot.

As further evident from FIGS. 7A-7D, in this example upper 602, the medial side component of the upper 602 that includes medial flap 610M is engaged with or integrally formed with the lateral side component of the upper 602 that includes the lateral flap 610L. More specifically, in this illustrated example, the medial side flap 610M is engaged with or integrally formed with the lateral side flap 610L via a rear strap member 610R that extends around a rear heel portion of the upper 602 and connects the medial side component of the upper 602 with the lateral side component of the upper 602. In this manner, the securing system 710 provides a tight and secure fit completely around the wearer's ankle.

The foot support systems 200/260 of these examples help support a midfoot area and/or forefoot area of a wearer's foot and help secure the midfoot area and/or forefoot area of the wearer's foot in the shoe. Optionally, the foot support systems 200/260 can allow easy insertion of the wearer's foot, and in some examples, can facilitate foot insertion, foot securing, and/or foot removal in a "hands free" and/or automatic manner.

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. A foot support system, comprising:

a medial side member including a medial side foot support base and a first medial side support extending upward from the medial side foot support base;

a lateral side member including a lateral side foot support base and a first lateral side support extending upward from the lateral side foot support base;

a hinge system connecting the medial side foot support base and the lateral side foot support base in a relative rotational manner, wherein the hinge system is configured to move the foot support system between: (a) a foot-insertion configuration and (b) a foot-containing configuration;

a locking system configured to releasably lock the hinge system to hold the foot support system in the foot-containing configuration; and a release mechanism configured to change the locking system from a locked state to an unlocked state, wherein the release mechanism includes: (a) a first lever extending to rear heel area of the foot support system, (b) a base support providing a portion of a plantar support surface of the foot support system, and (c) a cable having a first end engaged with the first lever and extending along the base support to the locking system, wherein movement of the first lever applies a force to unlock the locking system via the cable, and wherein:

(a) in moving from the foot-insertion configuration to the foot-containing configuration, interior surfaces of the medial side member and the lateral side member rotate about the hinge system with respect to one another in a direction toward one another, and (b) in moving from the foot-containing configuration to the foot-insertion configuration, interior surfaces of the medial side member and the lateral side member rotate about the hinge system with respect to one another in a direction away from one another.

2. The foot support system according to claim 1, wherein the cable applies the force to unlock the locking system in response to rotation of the first lever.

3. The foot support system according to claim 1, wherein the release mechanism includes:

a first hinge rotatably connecting the base support and the first lever, wherein rotation of the first lever with respect to the base support about the first hinge moves the cable such that the cable applies the force to unlock the locking system.

4. The foot support system according to claim 3, wherein the cable extends around the first hinge.

5. The foot support system according to claim 3, wherein, when a bottom surface of the foot support system is supported on a horizontal support surface, rotation of the first lever downward about the first hinge applies the force to unlock the locking system via the cable.

6. The foot support system according to claim 1:

wherein the base support includes a first side member and a second side member;

wherein the first lever includes a first end and a second end;

and wherein the release mechanism further includes:

a first hinge rotatably connecting the first side member of the base support and the first end of the first lever;

a second hinge rotatably connecting the second side member of the base support and the second end of the first lever; and wherein rotation of the first lever with respect to the base support about the first hinge and the second hinge moves the cable such that the cable applies the force to unlock the locking system.

7. The foot support system according to claim 6, wherein the base support and the first lever define a receptacle configured to receive a heel area of a user's foot.

8. The foot support system according to claim 1, further comprising:

a biasing system configured to bias the foot support system to the foot-insertion configuration when no foot is present in the foot support system.

9. The foot support system according to claim 8, wherein the biasing system includes a resilient member having at least a portion located beneath one or more of the hinge system, the medial side foot support base, and the lateral side foot support base.

10. The foot support system according to claim 1, further comprising:

a securing member configured to releasably secure the first medial side support with the first lateral side support.

11. The foot support system according to claim 1, further comprising:

a securing system releasably holding: (a) the first medial side support in place with respect to the medial side foot support base when the foot support system is in the foot-containing configuration and (b) the first lateral side support in place with respect to the lateral side foot support base when the foot support system is in the foot-containing configuration.

12. The foot support system according to claim 1, wherein, when a bottom surface of the foot support system is supported on a horizontal support surface, a horizontal plane exists above the horizontal support surface in which:

(a) in the foot-containing configuration, the entire hinge system connecting the medial side foot support base and the lateral side foot support base is located below the horizontal plane, and (b) in the foot-insertion configuration, at least a portion of the hinge system connecting the medial side foot support base and the lateral side foot support base is located above the horizontal plane.

13. The foot support system according to claim 1, wherein, when a bottom surface of the foot support system is supported on a horizontal support surface, a horizontal plane exists above the horizontal support surface in which:

(a) in the foot-containing configuration, the entire hinge system connecting the medial side foot support base and the lateral side foot support base, the entire medial side foot support base, and the entire lateral side foot support base are located below the horizontal plane, and (b) in the foot-insertion configuration, at least a portion of the hinge system connecting the medial side foot support base and the lateral side foot support base, at least a portion of the medial side foot support base, and at least a portion of the lateral side foot support base are located above the horizontal plane.

14. A foot support system, comprising:

a medial side member including a plurality of medial side support ribs configured to extend along a medial side portion of the foot support system;

a lateral side member including a plurality of lateral side support ribs configured to extend along a lateral side portion of the foot support system;

a hinge system engaging the medial side member and the lateral side member together such that the plurality of medial side support ribs and the plurality of lateral side support ribs are movable with respect to one another between: (a) a foot-insertion configuration and (b) a foot-containing configuration;

a locking system configured to releasably lock the hinge system to hold the plurality of medial side support ribs with respect to the plurality of lateral side support ribs in the foot-containing configuration; and a release mechanism configured to change the locking system from a locked state to an unlocked state, wherein the release mechanism includes: (a) a first lever extending to a rear heel area of the foot support system, (b) a base support providing a portion of a plantar support surface of the foot support system, and (c) a cable having a first end engaged with the first lever and extending along the base support to the locking system, wherein movement of the first lever applies a force to unlock the locking system via the cable, and wherein:

(a) in moving from the foot-insertion configuration to the foot-containing configuration, interior surfaces of the plurality of medial side support ribs and interior surfaces of the plurality of lateral side support ribs rotate in a direction toward one another, and (b) in moving from the foot-containing configuration to the foot-insertion configuration, interior surfaces of the plurality of medial side support ribs and interior surfaces of the plurality of lateral side support ribs rotate in a direction away from one another.

15. The foot support system according to claim 14, wherein the release mechanism includes:

a first hinge rotatably connecting the base support and the first lever;

wherein rotation of the first lever with respect to the base support about the first hinge moves the cable such that the cable applies the force to unlock the locking system.

16. The foot support system according to claim 15, wherein, when a bottom surface of the foot support system is supported on a horizontal support surface, rotation of the first lever downward about the first hinge applies the force to unlock the locking system via the cable.

17. The foot support system according to claim 14, wherein the base support includes a first side member and a second side member;

wherein the first lever includes a first end and a second end;

and wherein the release mechanism further includes:

a first hinge rotatably connecting the first side member of the base support and the first end of the first lever;

a second hinge rotatably connecting the second side member of the base support and the second end of the first lever; and wherein rotation of the first lever with respect to the base support about the first hinge and the second hinge moves the cable such that the cable applies the force to unlock the locking system.

18. The foot support system according to claim 17, wherein the base support and the first lever define a receptacle configured to receive a heel area of a user's foot.

19. A foot support system, comprising:

a medial side member including a medial side foot support base and a first medial side support extending upward from the medial side foot support base;

a lateral side member including a lateral side foot support base and a first lateral side support extending upward from the lateral side foot support base;

a hinge system connecting the medial side foot support base and the lateral side foot support base in a relative rotational manner, wherein the hinge system is configured to move the foot support system between: (a) a foot-insertion configuration and (b) a foot-containing configuration;

a locking system configured to releasably lock the hinge system to hold the foot support system in the foot-containing configuration; and a release mechanism configured to change the locking system from a locked state to an unlocked state, wherein the release mechanism includes:

a base support including a first side member and a second side member connected together and providing a portion of a plantar support surface of the foot support system, a first lever including a first end and a second end, wherein the first lever extends around a rear heel area of the foot support system, a first hinge rotatably connecting the first side member of the base support and the first end of the first lever, a second hinge rotatably connecting the second side member of the base support and the second end of the first lever, and a cable having a first end engaged with the first lever, wherein the cable extends around the first hinge and along the base support to the locking system, and wherein rotation of the first lever about the first hinge and the second hinge applies a force to unlock the locking system via the cable.

20. The foot support system according to claim 19, wherein, when a bottom surface of the foot support system is supported on a horizontal support surface, rotation of the first lever downward about the first hinge and the second hinge applies the force to unlock the locking system via the cable.

* * * * *